US007762438B2

(12) United States Patent
Skillin

(10) Patent No.: US 7,762,438 B2
(45) Date of Patent: Jul. 27, 2010

(54) DISPENSING CLOSURE WITH LATCH BACK

(75) Inventor: Clifford W. Skillin, Blackstone, MA (US)

(73) Assignee: Polytop Corporation, Slatersville, RI (US)

( * ) Notice: Subject to any disclaimer, the term of this patent is extended or adjusted under 35 U.S.C. 154(b) by 0 days.

(21) Appl. No.: 12/576,509

(22) Filed: Oct. 9, 2009

(65) Prior Publication Data

US 2010/0065589 A1 Mar. 18, 2010

Related U.S. Application Data

(63) Continuation-in-part of application No. 11/876,067, filed on Oct. 22, 2007, now Pat. No. 7,617,954, and a continuation-in-part of application No. 10/960,179, filed on Oct. 7, 2004, now Pat. No. 7,322,493.

(60) Provisional application No. 60/895,084, filed on Mar. 15, 2007, provisional application No. 60/587,518, filed on Jul. 13, 2004, provisional application No. 60/509,523, filed on Oct. 9, 2003.

(51) Int. Cl.
*B65D 47/00* (2006.01)

(52) U.S. Cl. ..... 222/556; 220/831; 215/245

(58) Field of Classification Search ..... 222/511–517, 222/556, 557, 518, 153.14, 498; 220/831, 220/832, 837–843, 817, 819; 215/289, 235–238, 215/245

See application file for complete search history.

(56) References Cited

U.S. PATENT DOCUMENTS

| | | | | |
|---|---|---|---|---|
| 4,010,875 | A | | 3/1977 | Babiol |
| 4,158,902 | A | | 6/1979 | Chernack et al. |
| 4,573,600 | A | | 3/1986 | Dubach |
| 4,625,898 | A | * | 12/1986 | Hazard ..... 222/517 |
| 4,635,823 | A | | 1/1987 | Stull |
| 4,778,071 | A | | 10/1988 | Fillmore |
| 4,917,253 | A | | 4/1990 | Dutt |
| 5,007,555 | A | | 4/1991 | Beck |
| 5,067,624 | A | | 11/1991 | Thanisch |
| 5,088,612 | A | | 2/1992 | Storar et al. |
| 5,271,536 | A | | 12/1993 | Wilson |
| 5,328,058 | A | | 7/1994 | Leoncavallo et al. |
| 5,437,383 | A | | 8/1995 | Stull |

(Continued)

FOREIGN PATENT DOCUMENTS

DE 7631199 U 1/1977

(Continued)

*Primary Examiner*—Lien T Ngo
(74) *Attorney, Agent, or Firm*—Barlow, Josephs & Holmes, Ltd.

(57) ABSTRACT

A closure body has a closure deck with a dispensing orifice. A lower peripheral skirt depends from the closure deck and is configured to be mounted on a container. A closure cap has an upper wall and a wall flange which depends from the upper wall. A hinge structure joins the wall flange to the lower peripheral skirt. A latch recess is defined within the lower peripheral skirt. A latch protrusion is located on the wall flange of the cap and positioned respectively positioned above the latch recess when closure cap is in a closed position. The latch protrusion and the latch recess define interfitting mating formations which engage to secure the cap to the closure body when the closure cap is in an open position.

25 Claims, 24 Drawing Sheets

U.S. PATENT DOCUMENTS

| | | | | |
|---|---|---|---|---|
| 5,735,418 | A | 4/1998 | Erb et al. | |
| 5,938,087 | A | 8/1999 | Randall | |
| 6,102,257 | A | 8/2000 | Goyet | |
| 6,116,477 | A | 9/2000 | Kreiseder et al. | |
| 6,305,563 | B1 | 10/2001 | Elliott | |
| 6,318,605 | B1 * | 11/2001 | Nyman et al. | 222/517 |
| 6,415,965 | B2 * | 7/2002 | Nyman et al. | 222/517 |
| 6,478,184 | B2 | 11/2002 | Berge et al. | |
| 6,481,588 | B1 | 11/2002 | Wagner | |
| 6,766,926 | B1 | 7/2004 | Elchert | |
| 6,837,402 | B2 | 1/2005 | Cardia | |
| 7,314,150 | B2 | 1/2008 | Skillin | |
| 7,322,493 | B2 | 1/2008 | Skillin | |
| 7,617,954 | B2 | 11/2009 | Skillin | |
| 2002/0148802 | A1 * | 10/2002 | Takahashi et al. | 215/237 |
| 2003/0057209 | A1 * | 3/2003 | Seelhofer | 220/259.1 |
| 2006/0011667 | A1 | 1/2006 | Skillin et al. | |

FOREIGN PATENT DOCUMENTS

| | | | |
|---|---|---|---|
| EP | 1386849 | A1 | 4/2004 |
| GB | 207638 | | 12/1923 |

* cited by examiner

DISPENSING CLOSURE WITH LATCH BACK

CROSS REFERENCE TO RELATED APPLICATIONS

This continuation-in-part application is related to and claims priority from earlier filed, U.S. Non-Provisional patent application Ser. No. 11,876,067 filed Oct. 22, 2007, which claims priority from earlier filed U.S. Provisional Patent Application No. 60/895,084 filed Mar. 15, 2007, and earlier filed U.S. Non-Provisional patent application Ser. No. 10/960,179 filed Oct. 7, 2004 now U.S. Pat. No. 7,322,493, and earlier filed U.S. Provisional Patent Application No. 60/587,518 filed Jul. 13, 2004, and earlier filed U.S. Provisional Patent Application No. 60/509,523 filed Oct. 9, 2003 all of which are incorporated herein by reference.

BACKGROUND OF THE INVENTION

The present application is related to dispensing closures for containers and more specifically to a dispensing closure that includes a latch back mechanism to restrain the cap when dispensing the contents of the container.

Dispensing containers are used in a variety of industries for the dispensing of various liquid products. For example, in the beauty industry, products such as shampoo, conditioner, creams and lotions are all packaged in flexible containers having a dispensing closure mounted thereon. Such dispensing containers are also used in the food industry for various condiments, such as ketchup, mayonnaise, and syrups.

One important aspect to the mounting of a dispensing closure in the food industry is retaining the lid in an open position so that the lid does not interfere with dispensing of the product. Often times, the lid naturally tends to return to the closed position after opening due to the memory aspect of the plastic. When this occurs, the lid interferes with dispensing of the product, making for a messy dispensing experience, and fouls the lid surfaces, making it difficult to close the lid.

Accordingly, there is believed to be a need in the industry for a dispensing closure having a latch back mechanism, which will retain the cap in an open position during dispensing.

BRIEF SUMMARY OF THE INVENTION

The present invention preserves the advantages of existing dispensing closures while providing new advantages not found in currently available dispensing closures and overcoming many disadvantages of such currently available dispensing closures. The general concept of the present invention is to provide a dispensing closure an efficient, low-cost fashion through use of a molded single-piece plastic construction with integrally molded living hinges and integrally molded features on the closure body and cap which are engaged to maintain the lid in an open position.

Generally, a dispensing closure has a closure cap or lid, closure body, and a hinge structure for connecting the closure cap or lid to the closure body. The closure body has a first upper wall. The first upper wall has a dispensing orifice therein. The closure body further includes an upper peripheral skirt depending from the first upper wall. The closure deck depends from the upper peripheral skirt. A second upper wall depends from the closure deck. A flow conduit depends from the first upper wall of the closure body and is positioned above and below the closure deck. The lower portion of the flow conduit includes an inner flow conduit wall depending downwardly from the closure deck.

In one embodiment, the closure body includes a first and second lower peripheral skirt depending from the closure deck. The second lower peripheral skirt respectively positioned below the second upper wall. An inner surface of the second lower peripheral skirt is configured to mount to a container. The first lower peripheral skirt has a diameter larger than the upper peripheral skirt and the second lower peripheral skirt. The first lower peripheral skirt defines a horizontal ledge at a top portion of the first lower peripheral skirt.

A closure cap has an upper wall and a wall flange which depends from the upper wall. A hinge structure joins the wall flange to the lower peripheral skirt. An inner surface of the closure cap is interfittingly mated with an outer surface of the closure body to secure the cap to the closure body when the closure cap is in a closed position.

In one embodiment, the hinge structure is a double hinge including a first and second living hinge. The first and second living hinges are positioned inwardly towards a center axis of the closure body and within an outer periphery of the cap. The first living hinge connects or joins a lower portion of the wall flange to a top portion of the first lower peripheral skirt. The second living hinge connects or joins a lower portion of the wall flange to the top portion of the first lower peripheral skirt. The cap is configured to move from an open position to a closed position overlying the closure deck of the closure body.

A latch recess is defined within the lower peripheral skirt of the closure body. The latch recess may be positioned or located between, adjacent, or near the first living hinge and the second living hinge. In one embodiment, the latch recess is defined with the horizontal ledge of the first lower peripheral skirt. The latch recess defines a generally, u-shaped, concave mating formation.

A vertical latch protrusion is positioned or located on the wall flange of the cap and positioned respectively above the latch recess when the closure cap is in a closed position. A portion of the closure cap is recessed for attaching the latch protrusion. The latch protrusion defines a generally u-shaped, convex mating formation. The latch protrusion and the latch recess define interfitting mating formations which engage to secure the cap to the closure body when the closure cap is in an open position. In operation, the cap is pivoted approximately 30 degrees below the closure body to engage said latch protrusion within the latch recess and "latch back" the closure cap to the closure body during dispensing of a product from the container.

It is therefore an object of the present invention to provide a one-piece low cost dispensing closure.

It is a further object of the embodiment to provide a dispensing closure which can latch back to secure a closure cap to a closure body during dispensing of a product.

Another object of the embodiment is to provide a dispensing closure which has a hinge structure for moving a closure cap relative to the closure body.

Another object of the embodiment is to hold the closure cap in a position away from a dispensing orifice during dispensing of a product.

Another object of the embodiment is to provide a dispensing closure with a hinge structure and latching mechanism that is within an outer periphery of the closure cap.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the dispensing closure are set forth in the appended claims. However, the dispensing closure, together with further embodiments and attendant advantages, will be best understood by reference to the following detailed description taken in connection with the accompanying drawing Figures.

DETAILED DESCRIPTION OF THE PREFERRED EMBODIMENTS

Figure 1:
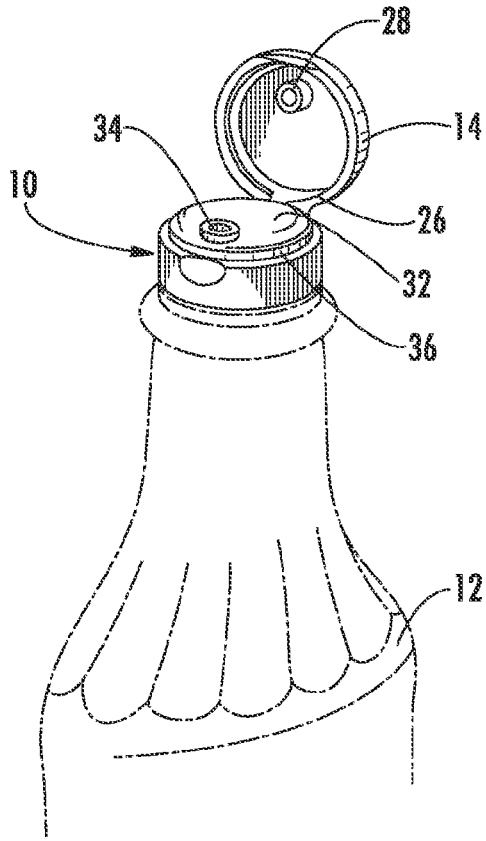
FIG. 1 is a perspective view of a first dispensing closure, constructed in accordance with the principles of the instant invention, applied to a container.

Referring now to the drawings, FIG. 1 depicts a first embodiment of a dispensing closure constructed in accordance with the principles of the invention. The dispensing closure is generally identified at 10, and is shown secured to the upper end of the neck of container 12. Container 12 may assume the form of a plastic bottle, which may be tilted, and squeezed, to discharge its contents through closure 10.

Figure 2:
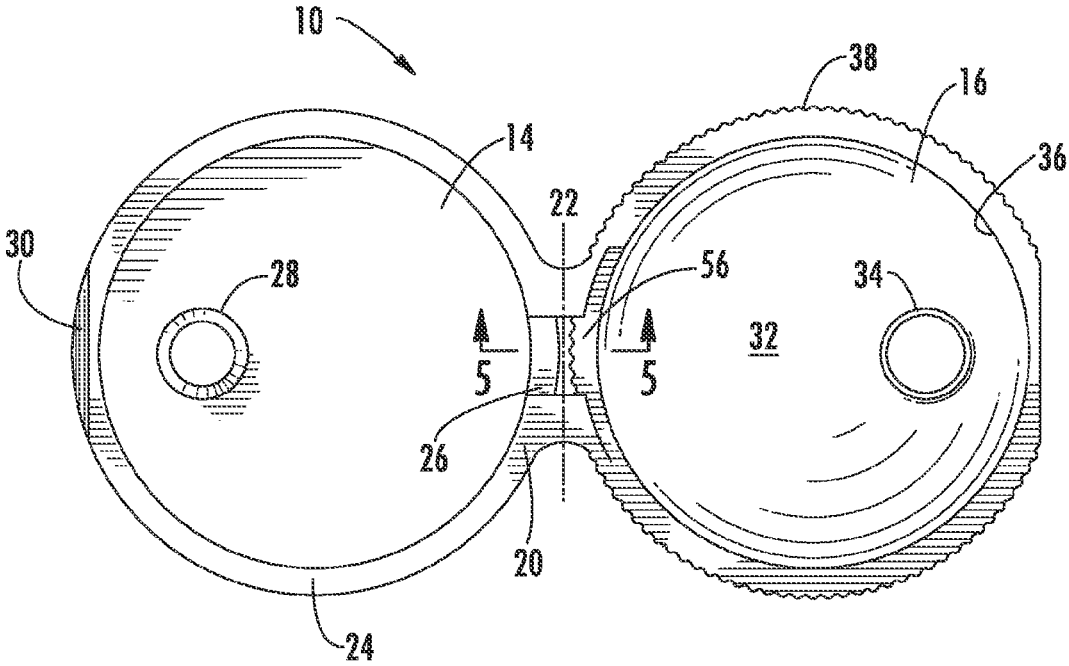
FIG. 2 is a top plan view of the dispensing closure, on an enlarged scale, such view showing the dispensing closure in its as-molded condition.

FIG. 2 shows dispensing closure 10 in its as-molded condition, prior to its securement to container 12. Closure 10 comprises sealing cap 14, a closure body 16, and a pair of hinges 18, 20 that join the sealing cap to the closure body. Sealing cap 14 is pivoted along the center line 22 of the hinges relative to closure body 16.

Figure 3:
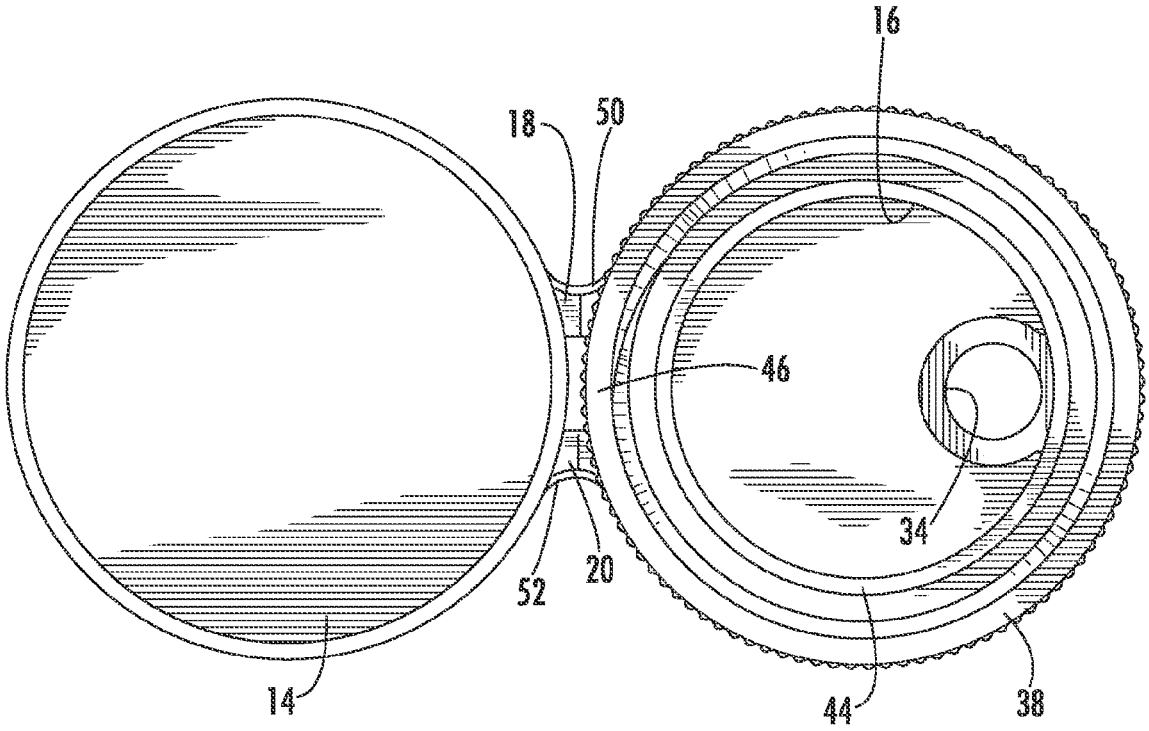
FIG. 3 is a bottom plan view of the dispensing closure of FIG. 2.

Sealing cap 14, as shown in FIGS. 2 and 3, includes an annular flange 24, a camming lug 26 located on flange 24 in proximity to closure body 16, and a depending peg 28. Camming lug 26 is curved, when viewed from above, and follows the contour of flange 24. Flange 24, remote from camming lug 26, is reduced in thickness to form gripping surface 30.

Closure body 16 includes a smooth upper wall 32 interrupted by dispensing orifice 34; the dispensing orifice communicates with the interior of the closure body. An annular sealing surface 36 is located below upper wall 32, and encircles closure body 16, and skirt 38 below the upper wall 32. Horizontal ledge 40 is formed between annular sealing surface 36 and skirt 38. An indentation 42 is formed in the exterior surface of skirt 38 at a location remote from hinges 18, 20, and in alignment with camming lug 26.

Locator ring 44 depends below upper wall 32 into the interior of closure body 16, and internal threads 46 are arranged in helical fashion around the interior of skirt 38. Ring 44 engages the end of the neck of container 12 to which dispensing closure 10 is applied, while threads 46 cooperate with complementary threads, or lugs, on the neck of the container 12 to secure dispensing closure 10 in fixed position.

FIGS. 2 and 3 show a dispensing closure, which is a unitary molding, in its as-molded condition, as it exits the mold. However, prior to use, in order to properly orient the molecular structure of the molded plastic in the area of living hinges 18, 20, sealing cap 14 is pivoted 180 degrees to its closed position. The sealing cap 14 as in FIGS. 6 and 7 indicates the position into which sealing cap 14 is pivoted to achieve the desired molecular orientation. Hinges 18, 20 are thin, resilient plastic members that are deformed repeatedly over the useful life of the dispensing closure, so that sturdy, durable hinges are necessary for successful operation.

Figure 4:
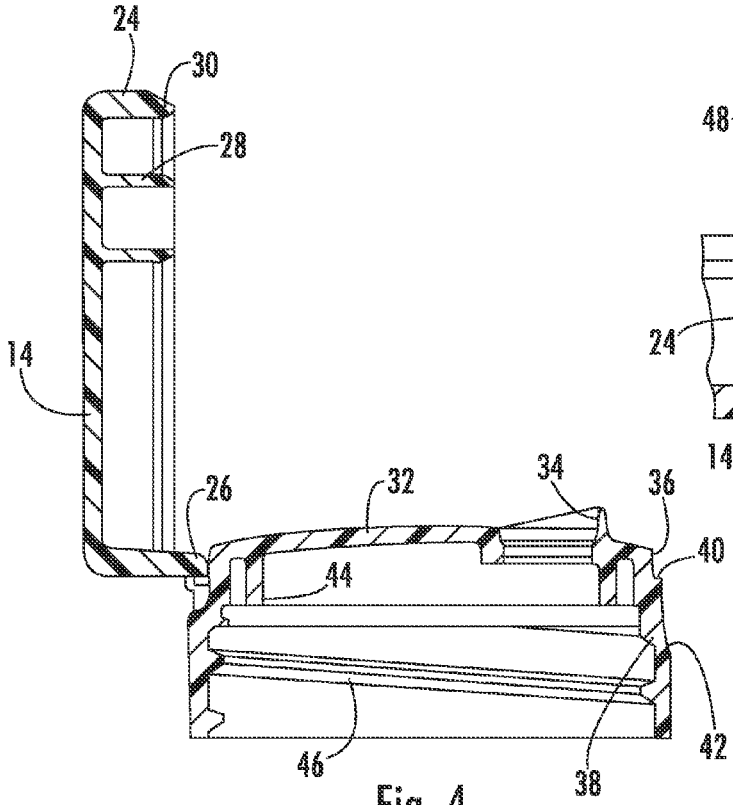
FIG. 4 is a vertical cross-sectional view of the dispensing closure with the sealing cap pivoted to its vertically oriented, opened position.
Figure 5:
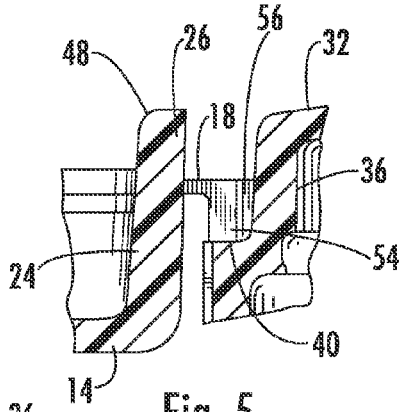
FIG. 5 is a fragmentary vertical cross-sectional view of the camming lug on the sealing cap that cooperates with a rigid wall on the closure body, such view being taken on an enlarged scale.

Camming lug 26 as shown in FIG. 5, extends beyond flange 24. Consequently, when sealing cap 14 is pivoted to the upright position (shown in FIG. 4), camming lug 26 engages, and slides along annular sealing surface 36 on closure body 16. The interference between camming lug 26 and annular sealing surface 36 stresses hinges 18, 20, and aligns the molecular structure of the plastic within the hinges. Edge 48 of camming lug 26 is rounded so that the camming lug does not gouge annular sealing surface 36, an important consideration since sealing cap 14 is pivoted to its closed position shortly after removal from the mold. Rounded edge 48 also enhances the snap-action of sealing cap 14.

Camming lug 26 is strategically located between spaced hinges 18, 20, for effectively stressing same within their elastic limits. The hinges may be strengthened, if warranted, by the addition of reinforcing ribs 50, 52. The ribs are visible in FIG. 3, and conform to the contour of the exterior edges of the hinges. The gap between sealing cap 14 and closure body 16, that is spanned by hinges 18, 20, is also visible.

Hinges 18 and 20 are each integrally formed with a holder. Holder 54 for hinge 18 is shown in FIG. 5, and a similar holder (not shown) is formed with hinge 20. In order to impart a limited degree of resiliency to holder 19, an arcuate recess 56 is removed from skirt 38 in the vicinity of the hinges and camming lug 26. The size and shape of segment 56 is shown in FIG. 2.

Recess 56 imparts resiliency to holder 54 for hinge 18, and does the same for the holder for hinge 20. The limited resiliency of the holders for hinges 18, 20 permits some relaxation of the close tolerances associated with dispensing closures, without sacrificing desirable operational characteristics.

Figure 6:
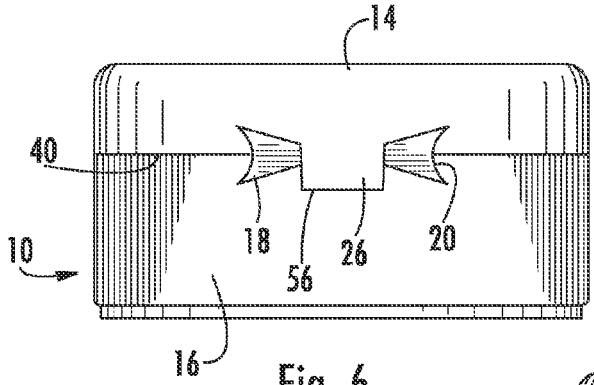
FIG. 6 is a rear elevational view of the dispensing closure showing the hinges that join the sealing cap to the closure body.

As shown in FIG. 6, recess 56 receives camming lug 26 when sealing cap 14 is swung into sealing engagement with closure body 16. Flange 24 of sealing cap 14 contacts ledge 40 to form a snug seal about the circumference of ledge 40. The inner surface of flange 24 contacts annular sealing surface 36 to further enhance the efficiency of the sealing action, which keeps water and/or other fluids from reaching the interior of the closed dispenser closure. Additionally, dispensing closure 10, when closed, assumes a compact, or low, profile.

Figure 7:
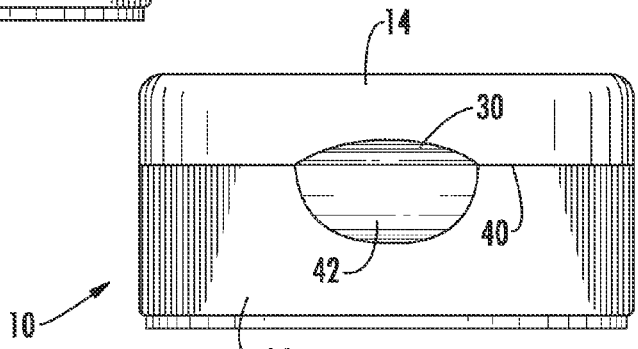
FIG. 7 is a front elevational view of the dispensing closure showing the gripping surfaces that allow the user to open the dispensing closure.

FIG. 7 shows gripping surface 30 on sealing cap 14 in relationship to indentation 42 on skirt 38 of closure body 16. Surface 30 and indentation 42 cooperate to allow the user of the cap to insert his finger beneath sealing cap 14 and manually lift same. After the sealing cap is pivoted partially toward its vertical, or opened position, camming lug 26, in concert with hinges 18, 20 imparts a snap-action to the sealing cap. Sealing cap 14 is retained in its vertical position by camming lug 26 pressing against annular sealing surface 36 on the closure body, in opposition to the forces imparted by hinges 18 and 20, as shown in FIG. 4.

Closure 10, as shown in FIGS. 1-7 and as described in the foregoing specification, realizes several advantages over known dispensing closures. To illustrate, the significant sealing area defined between flange 24 and ledge 40, as well as the back-up seal between the surface of annular sealing surface 36 and flange 24, allows the closure to be used on food products, such as ketchup, syrups, and the like. After filling, containers, for such products, such as flexible plastic bottles, are subjected to warm water baths to wash away excess product, dust, and the like. Such warm water baths have occasionally left droplets of water behind—an unsightly proposition that offends the ultimate user and may even pose a minor health hazard. Closure 10, as presently configured, obviates such problem in an efficient, low-cost fashion.

Furthermore, the use of pair of spaced hinges 18, 20, has materially increased the resistance of closure 10 to twisting forces. Such forces come into play as automated capping machinery applies torque to the closure to screw same onto the neck of a container or if consumers twist the closure to remove it from the neck of the container.

Hinges 18 and 20 are folded when sealing cap 14 is engaged, in sealing relationship, with closure body 16. As shown in FIG. 6, the folded hinges project outwardly a small distance from the closure body, and do not interfere with the sealing engagement of flange 24 and ledge 40, and/or with the interior surface of flange 24 and annular sealing surface 36. Also, closure 10 is aesthetically pleasing, with a slightly curved upper wall 32 on closure body 16, such wall being unbroken except for dispensing orifice 34. The manner in which camming lug 26 fits into recess 56 when sealing cap 14 is closed, is also pleasing to the eye, and precludes accumulation of excess food product, and/or dire, after discharge from container 12.

Figure 8:
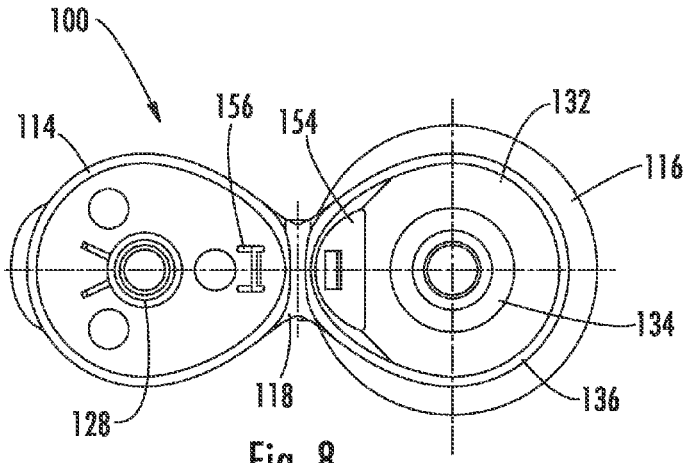
FIG. 8 is a top plan view of an alternative embodiment of the invention wherein the dispensing spout, i.e. orifice has been moved to the central axis of the closure.

Referring now to FIG. 8, an alternative closure generally indicated at 100 comprises a sealing cap 114 and a closure body 116 connected by hinge 118. The closure 100 generally has a taller configuration and the dispensing orifice 134 is centered on the closure body 116. the dispensing orifice 134 is composed a narrower upper channel 134*a* and a wider lower channel 134*b* to employ fluid dynamic principles to minimize spillage of the contents after the consumer dispenses the desired amount of product.

Sealing cap 114 is pivoted about the hinge between an open and closed configuration. Closure body 116 is provided with deck 132 and dispensing orifice 134 centrally located and extending upwardly from deck 132. Extending about the full circumference of the deck is sealing surface 136. Located inwardly of this sealing surface is rib 152 and recess 154.

Figure 9:
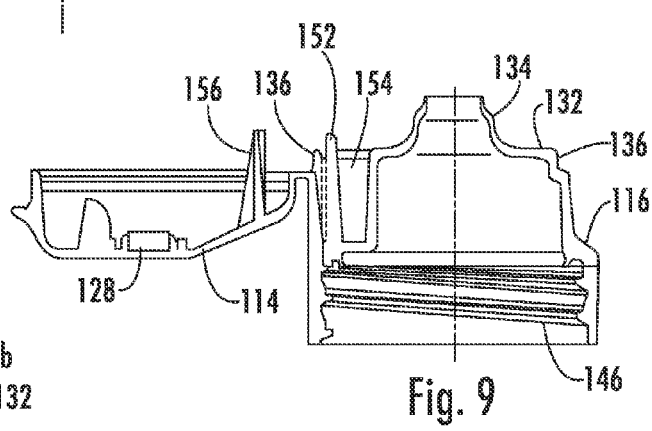
FIG. 9 is a cross-sectional view with the cap in the open position.

The structure of the sealing cap can also be seen in the cross-sectional view of FIG. 9. As can be seen, the sealing cap 114 is provided with a plug 128 that cooperates with dispensing orifice 134. Extending from the sealing cap is a peripheral skirt that cooperates with the sealing surface 136. Extension 156 extends from the underside of the sealing cap 114 and whose function will be described later. As can be seen, the closure has threads 146 for attaching the closure to the neck of a bottle.

Figure 10:
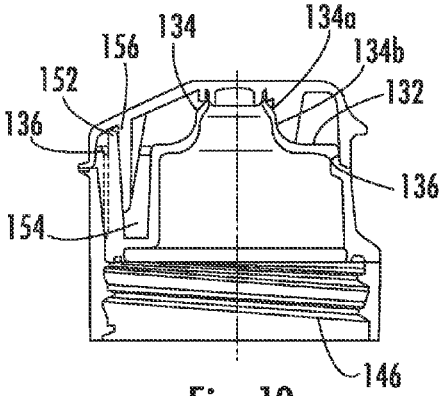
FIG. 10 is a cross-sectional view with the cap in the closed position.

FIG. 10 shows an enclosed configuration of the closure. Clearly seen is the plug 128 in engagement with the dispensing orifice 134. Also, the seal between the skirt of the sealing cap and the annular sealing surface 136 is completely seen, including the seal immediately adjacent the hinge. The seal between the skirt and annular sealing surface 136 extends about the entire periphery of the deck. As can be seen in this figure as well, is the placement of the extension 156 into the recess 154. As can be seen, while closing the sealing cap, rib 152 and extension 156 come into direct contact, providing a camming action when the sealing cap is opened and closed.

Figure 11:
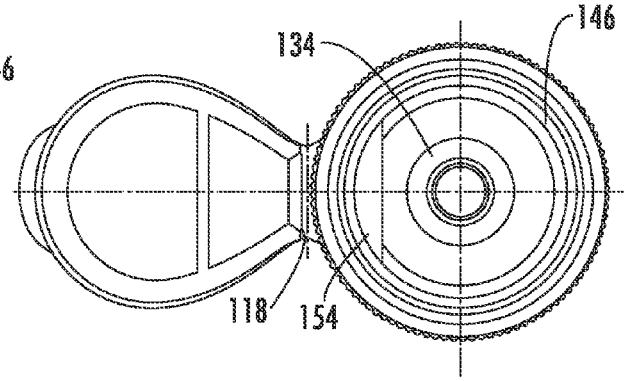
FIG. 11 is a bottom view of the closure with the cap in the open position.
Figure 12:
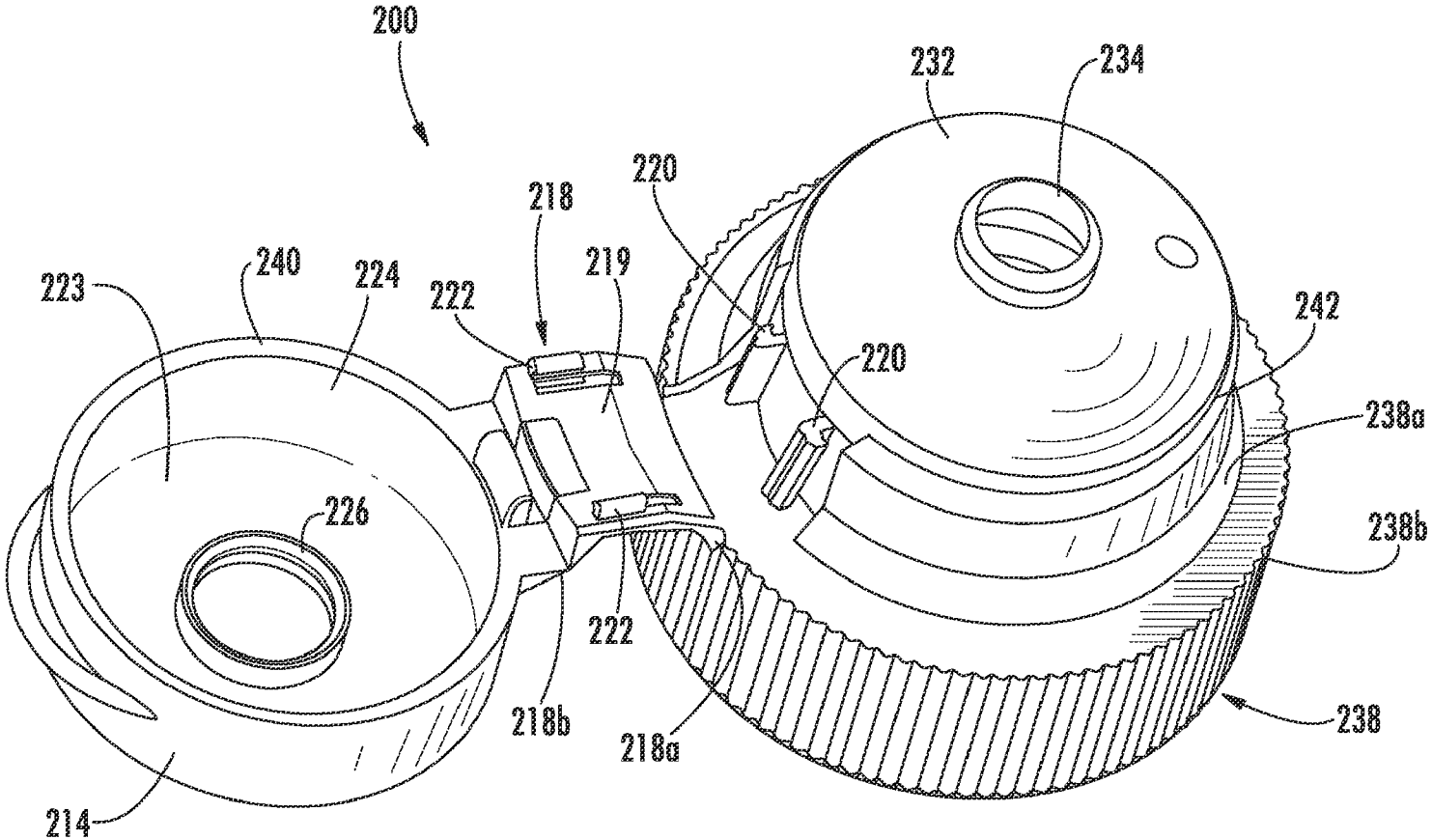
FIG. 12 is a perspective of a third and most preferred embodiment of the invention showing the cap in its as-molded condition.
Figure 13:
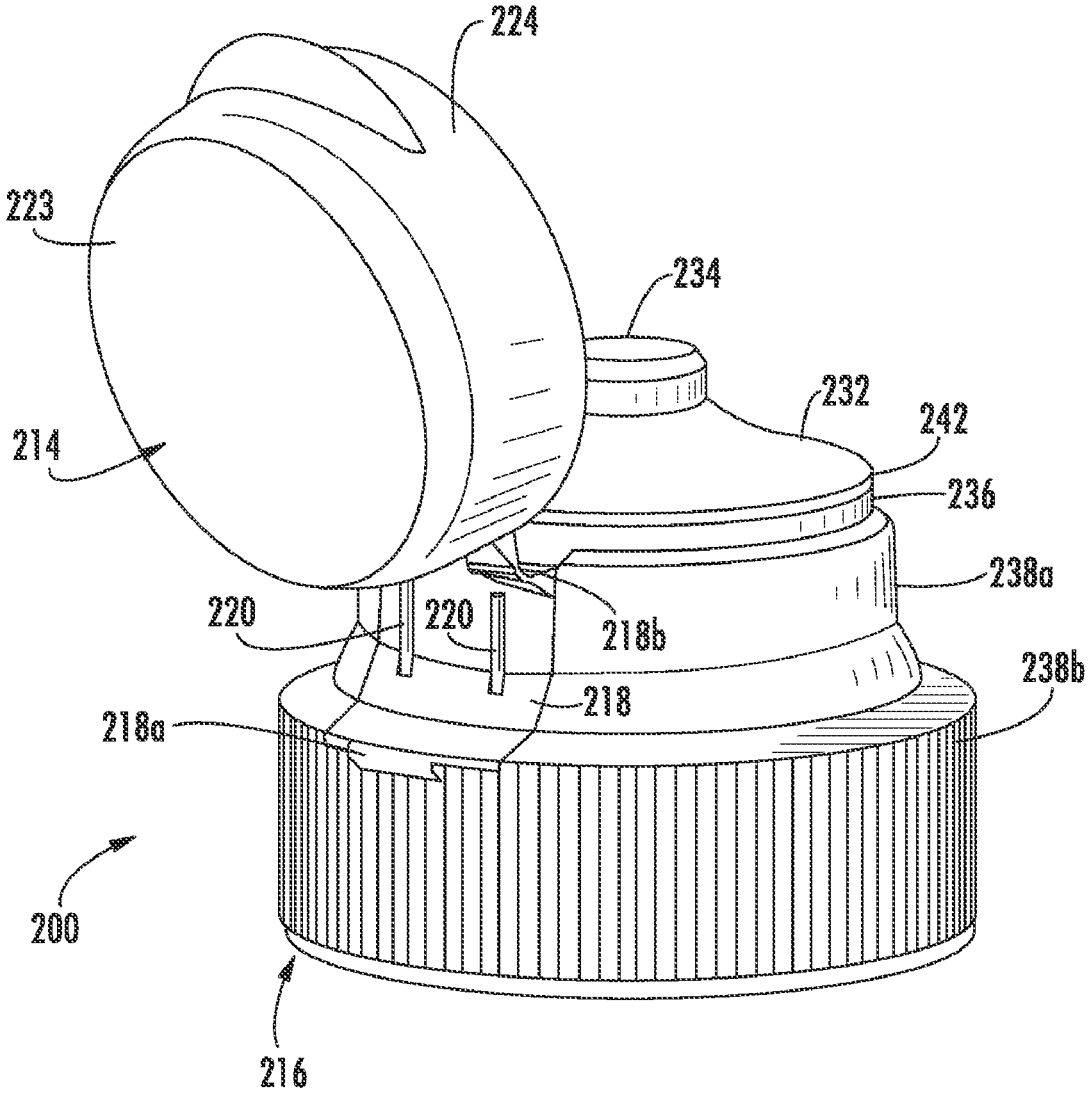
FIG. 13 is another perspective view thereof showing the cap in an intermediate position with the hinge arm locked onto the body of the cap.
Figure 14:
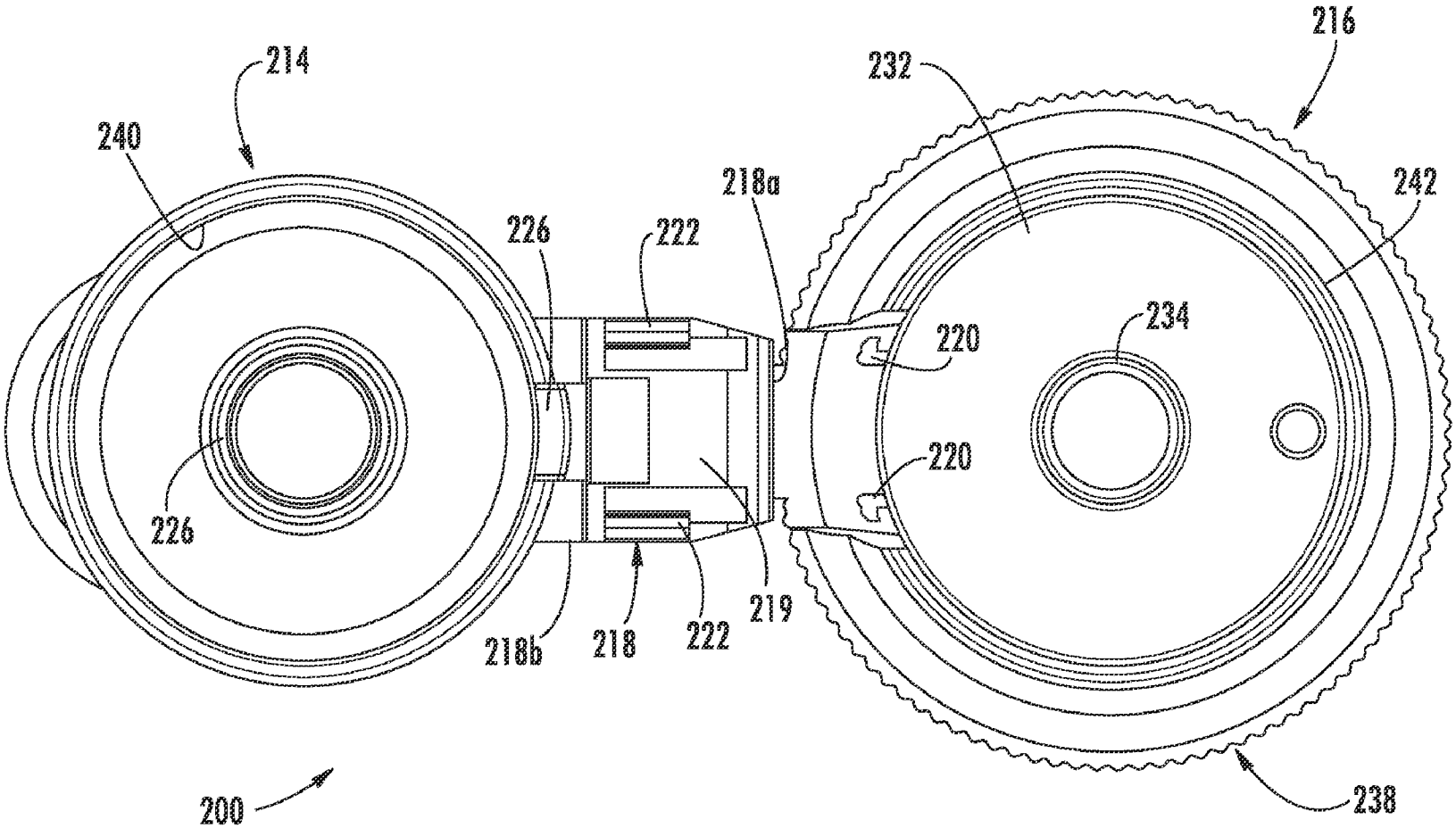
FIG. 14 is a top plan view thereof.

FIG. 11 shows the bottom side of the closure. As can be seen, the bottom of recess 154 does not interfere with the dispensing of contents through dispensing orifice 134 or the engagement of threads 146 onto a container.

FIGS. 12-19 illustrates a third and most preferred embodiment of the invention that combines all of the valued features of the earlier described embodiments, such as low profile hinge structure, symmetrical outer body structure, centrally positioned dispensing orifice, and complete peripheral seals. Similar to the embodiment in FIGS. 8-11, the dispensing orifice 234 is centrally aligned along the central axis of the closure body 216. However, the hinge structure 218 is modified so as to blend into the peripheral skirt 238 of the closure body 216, obviating the need to orient the closure 200 when mounted on a container 12.

The closure is generally indicated at 200 and comprises a sealing cap 214 and a closure body 216 integrally connected by a hinge structure 218 having two living hinges 218*a* and 218*b*.

The closure sealing cap 214 includes an upper wall 223, annular flange wall 224 depending downwardly from the upper wall 223, and a central sealing bead 226 depending downwardly from the center of the upper wall 223.

The closure body 216 has an upper wall 232 including a centrally positioned dispensing orifice 234, an annular sealing surface 236, an upper peripheral skirt 238*a* and a lower peripheral skirt 238*b*.

The sealing cap 214 is connected to the closure body 216 by a hinge structure 218 that is specifically designed to form a low profile when snapped into position. The living hinge 218 includes a hinge body 219 having a body hinge 218*a* adjacent to the closure body 216 and a sealing cap hinge 218*b* adjacent to the sealing cap 214. The hinge body 219 and the upper peripheral skirt 238*a* of the closure body 216 are provided with interfitting mating formations 220 and 222 that snap together when the hinge body 219 is rotated about the body hinge 218*a*. More specifically, the formations 220 and 222 comprise two hook-shaped tabs 220 in the surface of the upper peripheral flange 238*a* and two complimentary receiving tabs 222 on the hinge body 219. However, other similar configurations are possible. The intention of the hinge structure 218 is to provide a low profile, substantially flush engagement when snapped into position. In the as molded configuration, the closure body 216, hinge structure 218, and sealing cap 214 are laid out flat (See FIGS. 12, 14, 15, and 18). Upon removal from the mold, the hinge body 219 is pivoted about the body hinge 218*a* so that the sealing cap hinge 218*b* is positioned in proximity to the upper wall 232 of the closure body 216, with the sealing cap oriented 90 degrees relative to the upper wall of the closure body (see FIG. 13).

The sealing cap hinge 218*b* has a similar configuration to the hinge tab structure 26 shown in FIG. 4, and is movable between an open position (FIG. 13) and a closed position (not fully shown). When the sealing cap 214 is moved into the fully closed position the sealing bead 226 encircles and engages the outer walls of the dispensing orifice 234 to seal the dispensing orifice 234 at the opening.

Referring back to FIG. 12, the dispensing closure 200 is shown in its as-molded condition. Therefore hinges 218*a*, 218*b* are formed in a 90 degree open configuration and contrary to industry practice of forming living hinges in a 180 degree open or flat configuration.

To provide a complete peripheral seal around the upper wall 232, i.e. to prevent water from infiltrating onto the upper wall 232, the lower edge of the flange wall 224 of the sealing cap 214 includes a continuous peripheral sealing bead 240. When the sealing cap 214 is moved to the closed position, the sealing bead 240 engages the entire circumference of the annular sealing surface 236 to form a continuous primary seal around the circumference of the closure 200. In addition, to form a secondary sealing line, the outer peripheral edge of the upper wall 232 includes a peripheral sealing bead 242 that engages the inner wall of the sealing cap flange 224 when the sealing cap 214 is moved to the closed position.

Figure 19:
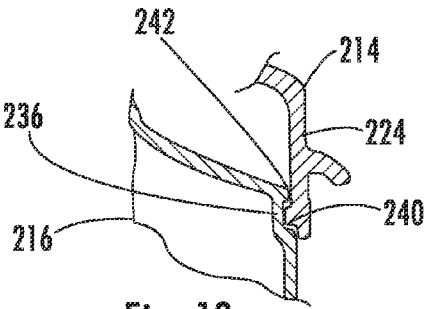
FIG. 19 is an enlarged cross-section view showing the sealing cap in the closure position and the two lines of peripheral sealing between the sealing cap flange and the annular sealing surface.

In particular, please refer to FIG. 19, which shows the sealing configuration in better detail.

Figure 15:
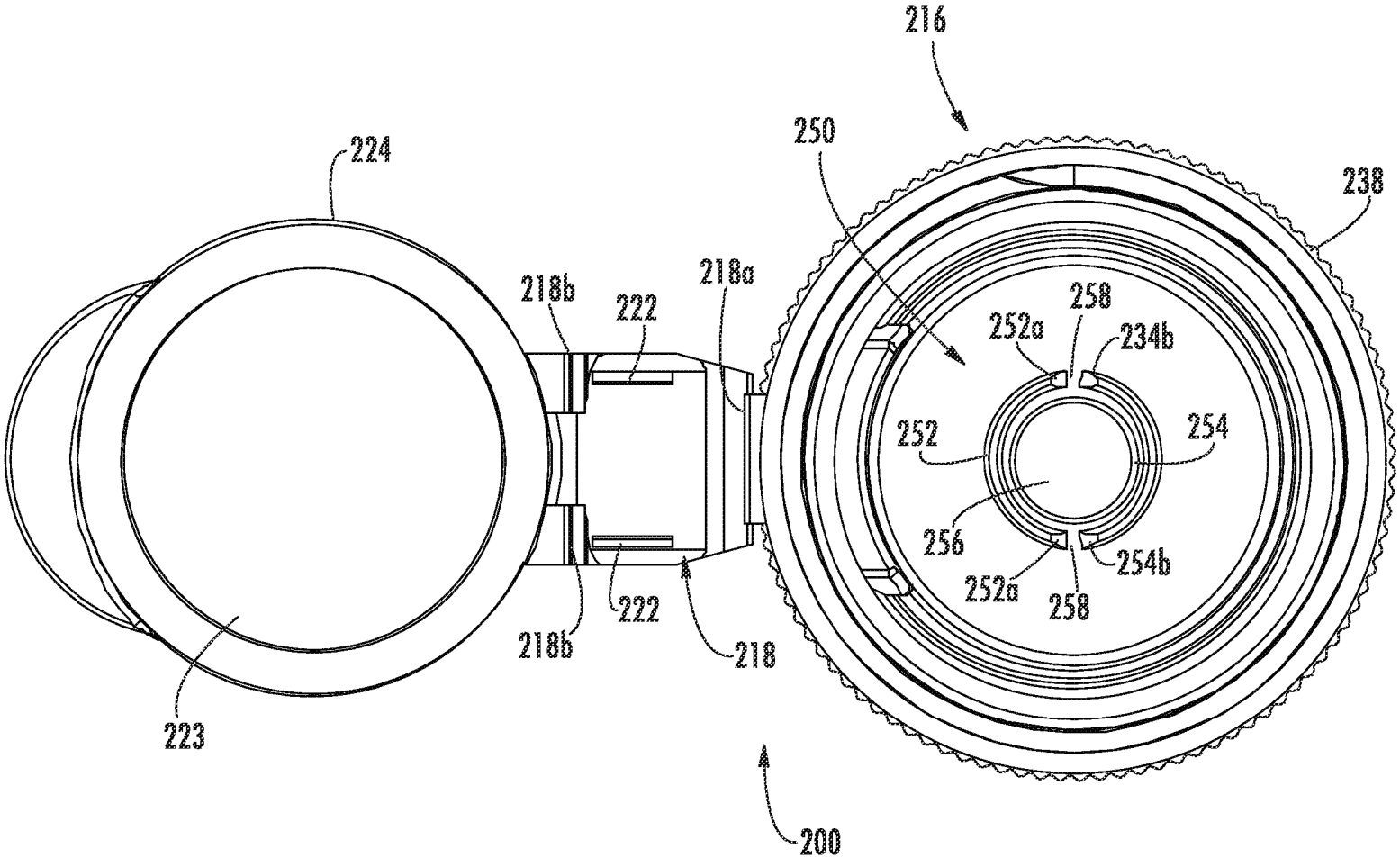
FIG. 15 is a bottom plan view thereof.
Figure 16:
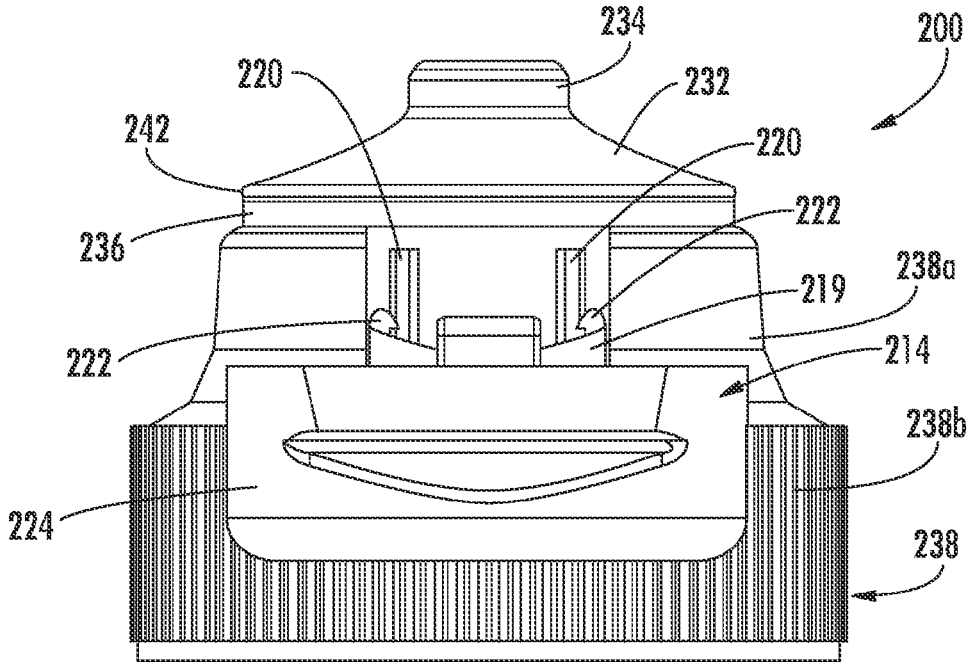
FIG. 16 is a left side plan view thereof.
Figure 17:
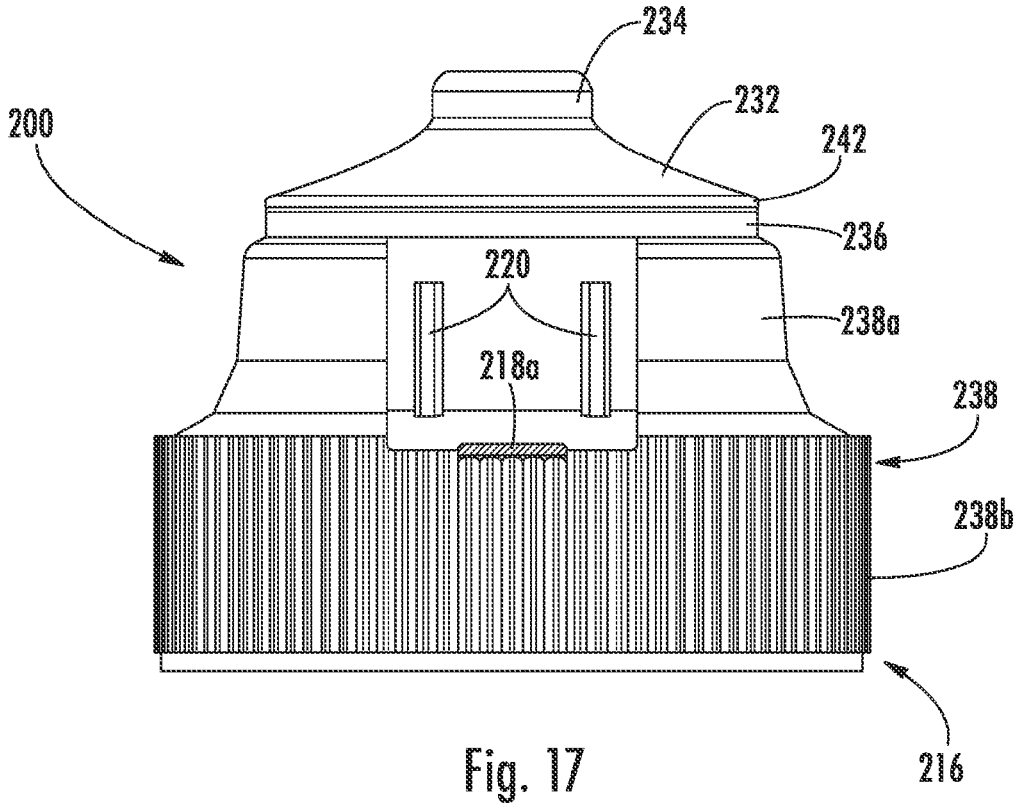
FIG. 17 is a cross-sectional view thereof.
Figure 18:
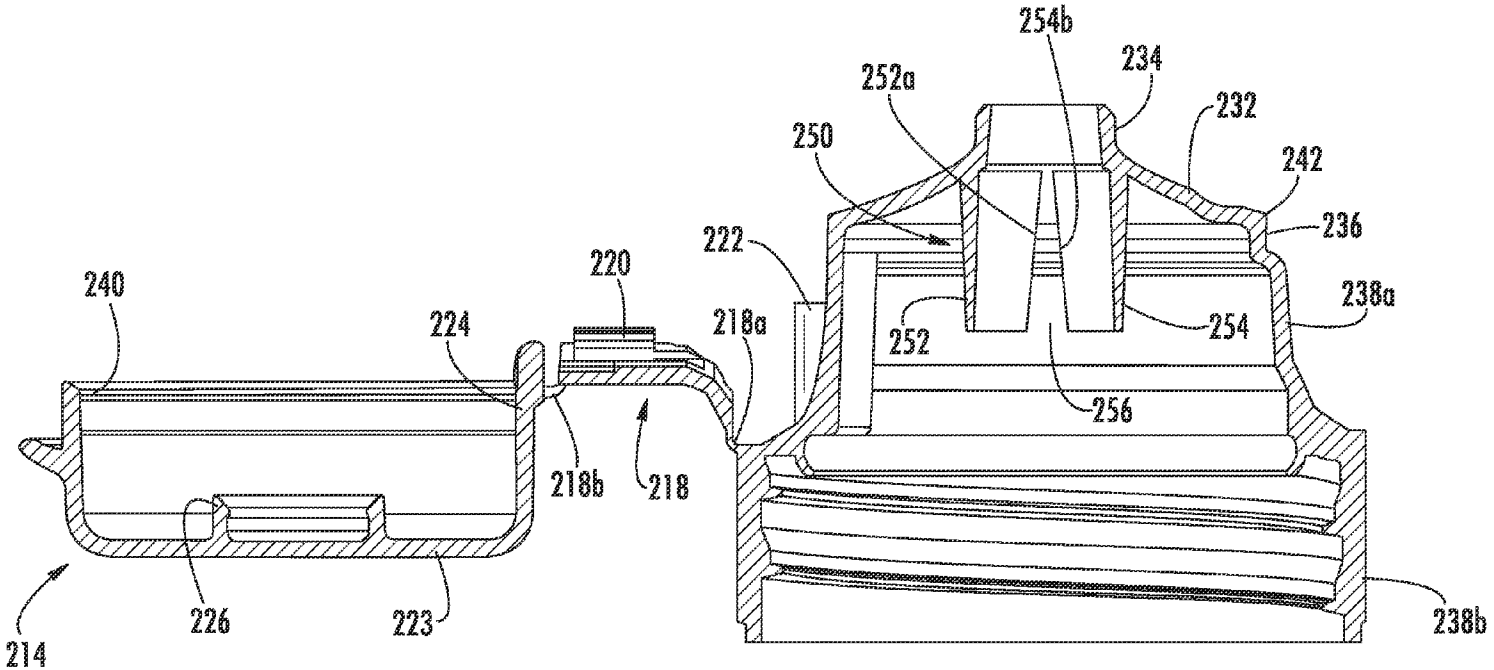
FIG. 18 is another cross-sectional view thereof.

Referring now to FIGS. 15 and 18, depending from the inside surface of the upper wall 232 and surrounding the dispensing orifice 234 is a flow modulator 250. The flow modulator 250 has two spaced-apart flow walls 252, 254 that are configured to face each other and form a channel 256. The flow walls 252, 254 have two restriction edges 252*a*, 254*b* that taper inwardly towards one another to form two relief openings 258 that are generally V-shaped. The function of the flow modulator 250 is to provide added restriction to the flow of a viscous fluid through the dispensing orifice and to prevent spillage of the fluid onto the outside surface of the upper wall 232.

Figure 20:
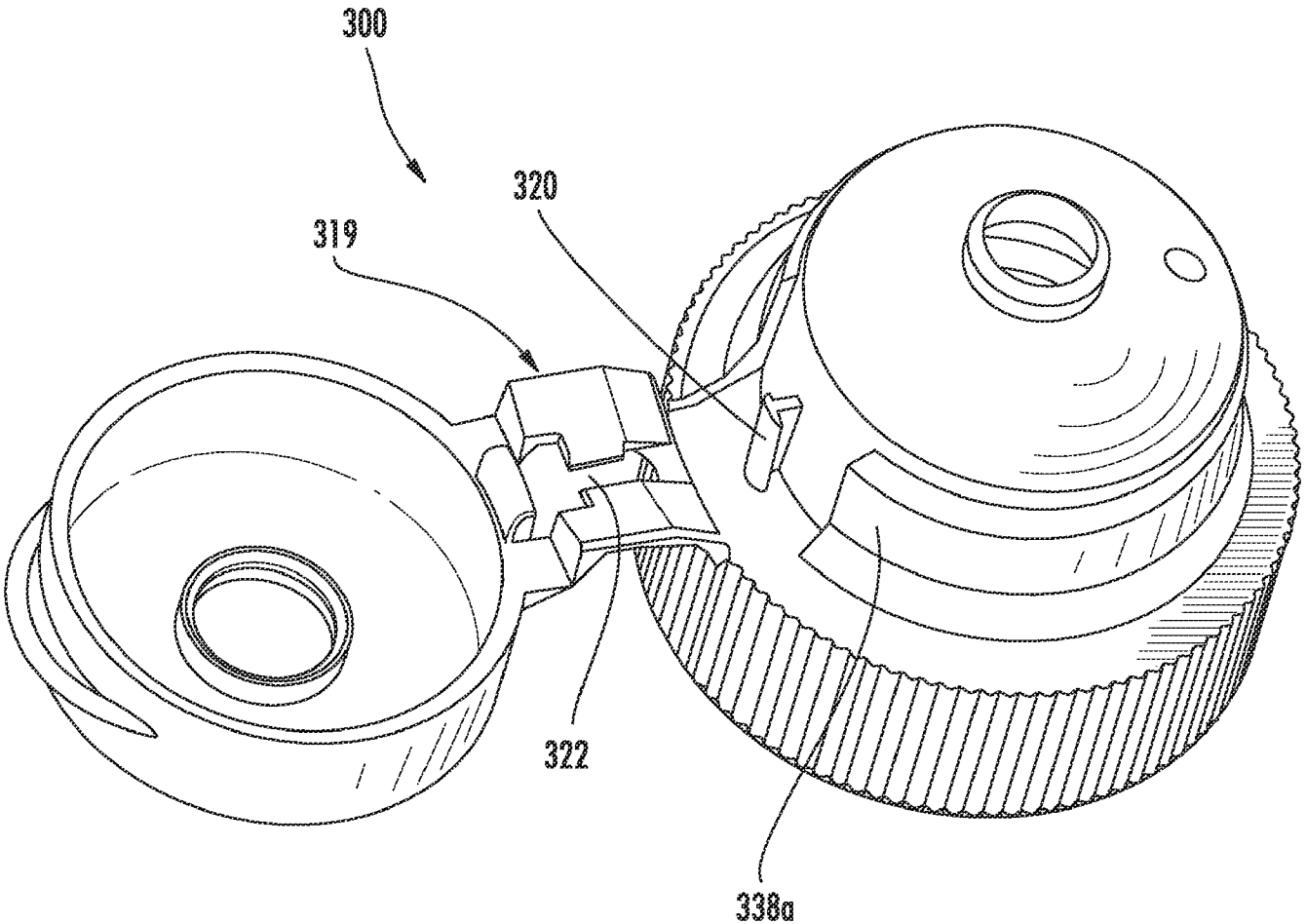
FIG. 20 is a perspective view of a fourth embodiment.
Figure 21:
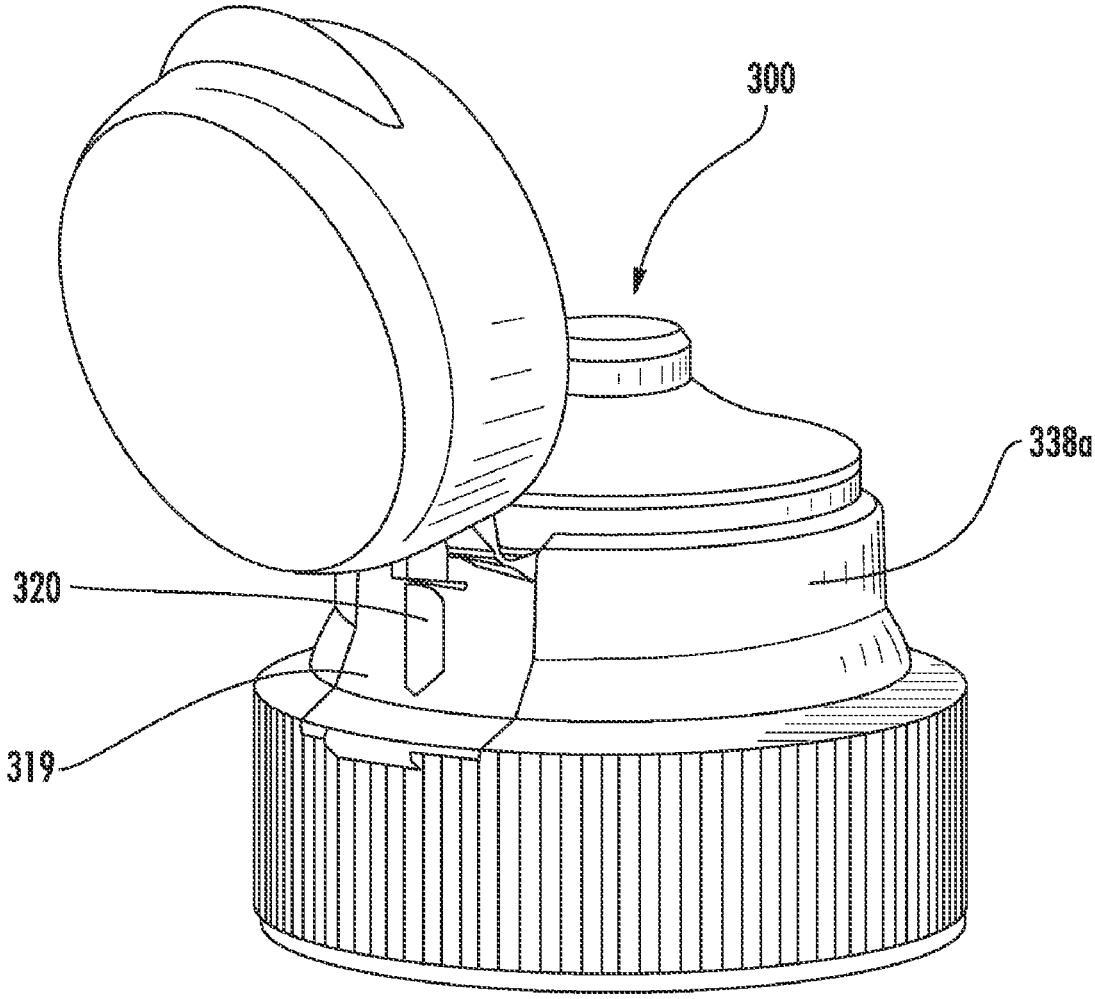
FIG. 21 is another perspective view of the fourth embodiment.

FIGS. 20 and 21 show an alternative embodiment for the configuration of the instant invention at 300. In particular, the interfitting mating formations comprise a T-shaped tab 320 located on the upper peripheral flange 338*a*, and a complimentary slot 322 located on the hinge body 319.

Figure 22:
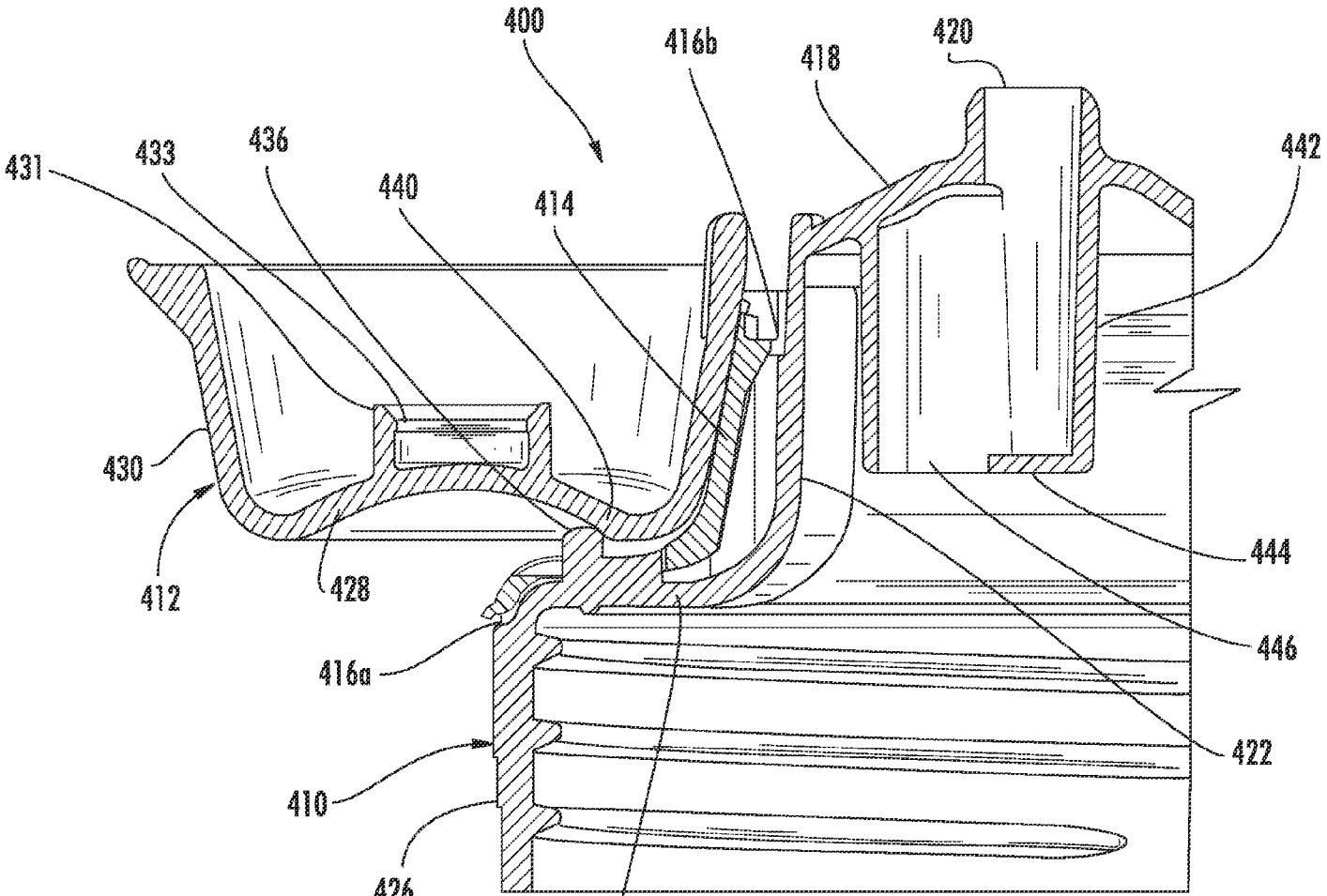
FIG. 22 is a cross-section view of a fifth embodiment of the invention illustrating a latch back feature.
Figure 23:
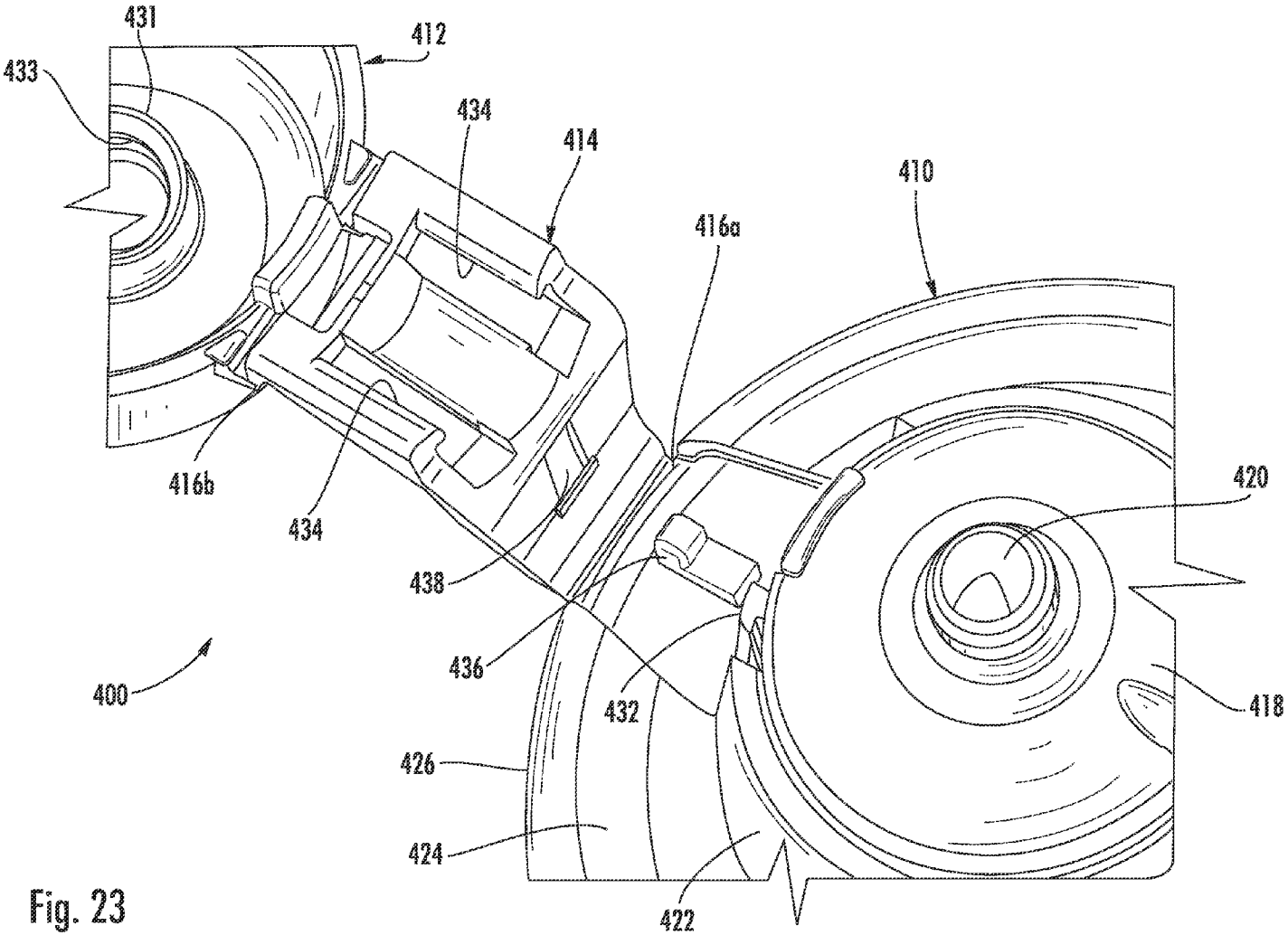
FIG. 23 is a bottom perspective view thereof showing the hinge body in an open position.
Figure 24:
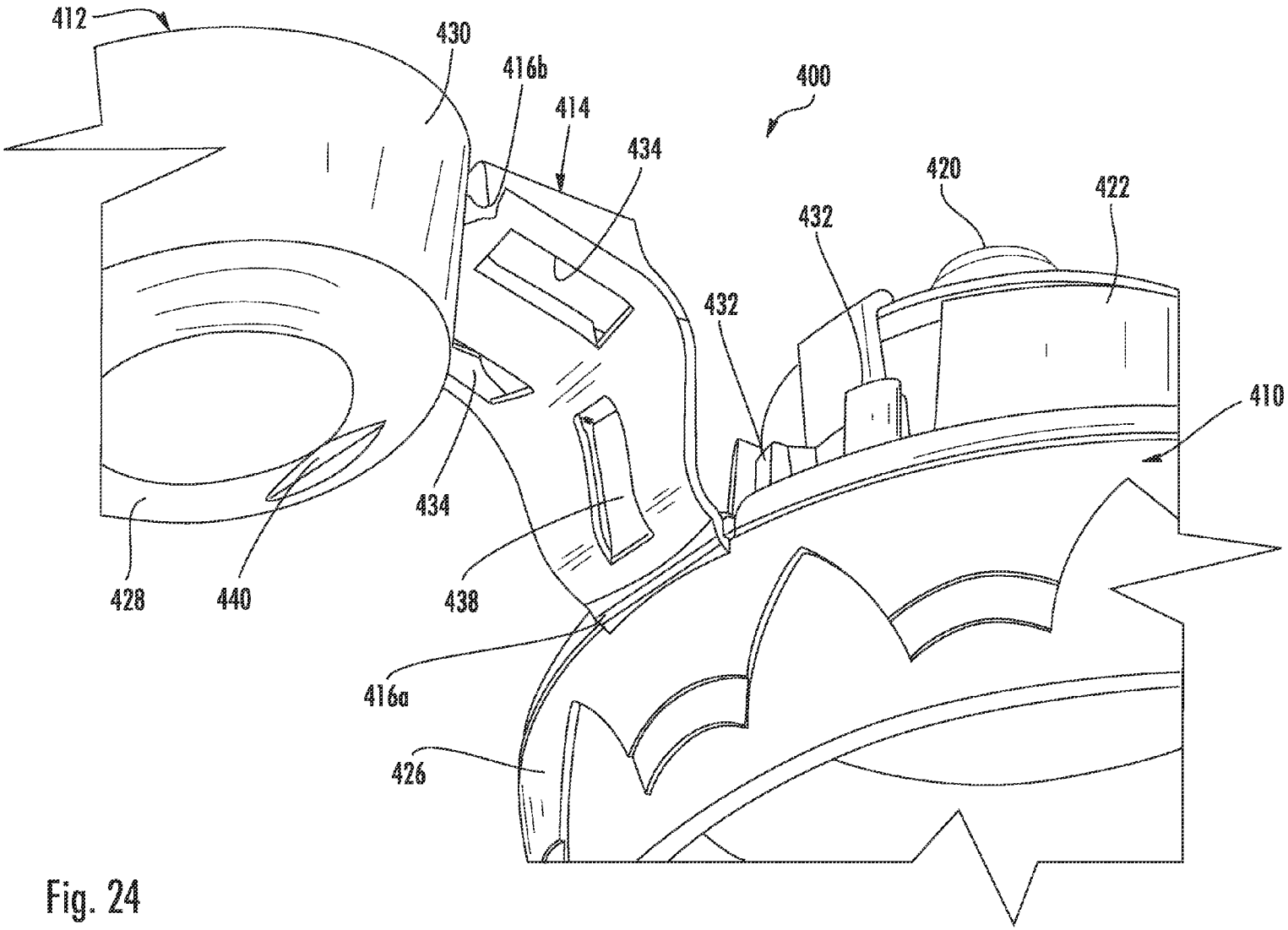
FIG. 24 is a top perspective view thereof showing the position of the latch bump and the clearance window.

Referring now to FIGS. 22-24, a fifth embodiment 400 of the dispensing closure is illustrated. Generally, the dispensing closure 400 comprises a closure body 410, a cap or lid 412, and a hinge body 414 having a first living hinge 416*a* connecting the hinge body 414 to the closure body 410, and a second living hinge 416*b* connecting the hinge body 414 to the cap 412. The overall construction of this embodiment is similar to the previous embodiment 300 with regard to the closure body 410, cap 412 and dual living hinges 416*a*, 416*b*. However, this fifth embodiment 400 further includes latch back structures, which will allow the cap 412 to be retained in an open position during dispensing. See FIG. 22 for fully open, latched position.

The closure body 410 includes an upper wall 418 having a dispensing orifice 420, an upper peripheral skirt 422 depending from the upper wall 418, a closure deck 424 depending from the upper peripheral skirt 422, and a lower peripheral skirt 426 depending from the closure deck 424. The lower peripheral skirt 426 has a diameter larger than the upper peripheral skirt 422 and is configured to be mounted on a container, either by a thread or a snap bead. The cap has an upper wall 428 and a wall flange 430 depending from the upper wall 428. On the upper wall 428 and within the periphery of the wall flange 430 is a sealing wall 431 depending downwardly from the center of the upper wall 428. The sealing wall 431 engages and seals the dispensing orifice 420 when the cap is rotated to the closed position. The sealing wall 431 further includes a sealing bead 433 to enhance the sealing action of the cap.

The hinge body 414 is hingeably movable about the first living hinge 416*a* from an open position to a closed position in facing mating relation with the upper peripheral skirt 422. To retain the hinge body 414 in position, the hinge body 414 and the upper peripheral skirt 422 including interfitting mating formations 432, 434 to secure the hinge body 414 in facing mating relation with the upper peripheral skirt 422. A second living hinge 416*b* joins the hinge body 414 to the sealing cap 412. The sealing cap 412 is hingeably movable from an open position to a closed position overlying the upper wall 418 of the closure body 410.

More specifically with regard to the latch back feature, the closure deck 424 is provided with a latch bump 436 adjacent to the hinge body 414 (See FIGS. 22 and 23). The latch bump 436 is formed on the surface of the closure deck 424 and protrudes upwardly through a clearance window 438 within the hinge body 414. A latch bead 440 is formed on the upper wall 428 of the cap 412 (See FIGS. 22 and 24). When the cap 412 is moved 180 degrees from the closed position to the open position, the lid latch bead 440 engages with the latch bump 436 and retains the cap or lid 412 in a fully open position.

Positioning the latch bump 436 on the closure deck 424 provides significant advantages in molding and allows for a substantial bump structure that can securely engage the latch bead 440. In particular, the latch bead 436 and window 438 permit the closure 400 to be molded without any undercuts in the mold.

Depending downwardly from the upper wall 418 of the closure body 410, is a flow restrictor 442 that encircles to the dispensing orifice 420. The flow restrictor 442 includes a bottom wall 442 and an opening 446 that is offset from the dispensing orifice 420. The combination of the offset opening 446 and bottom wall 444 prevents syneresis fluid from exiting the dispensing orifice 420 during the dispensing of the contents of the container.

Figure 25:
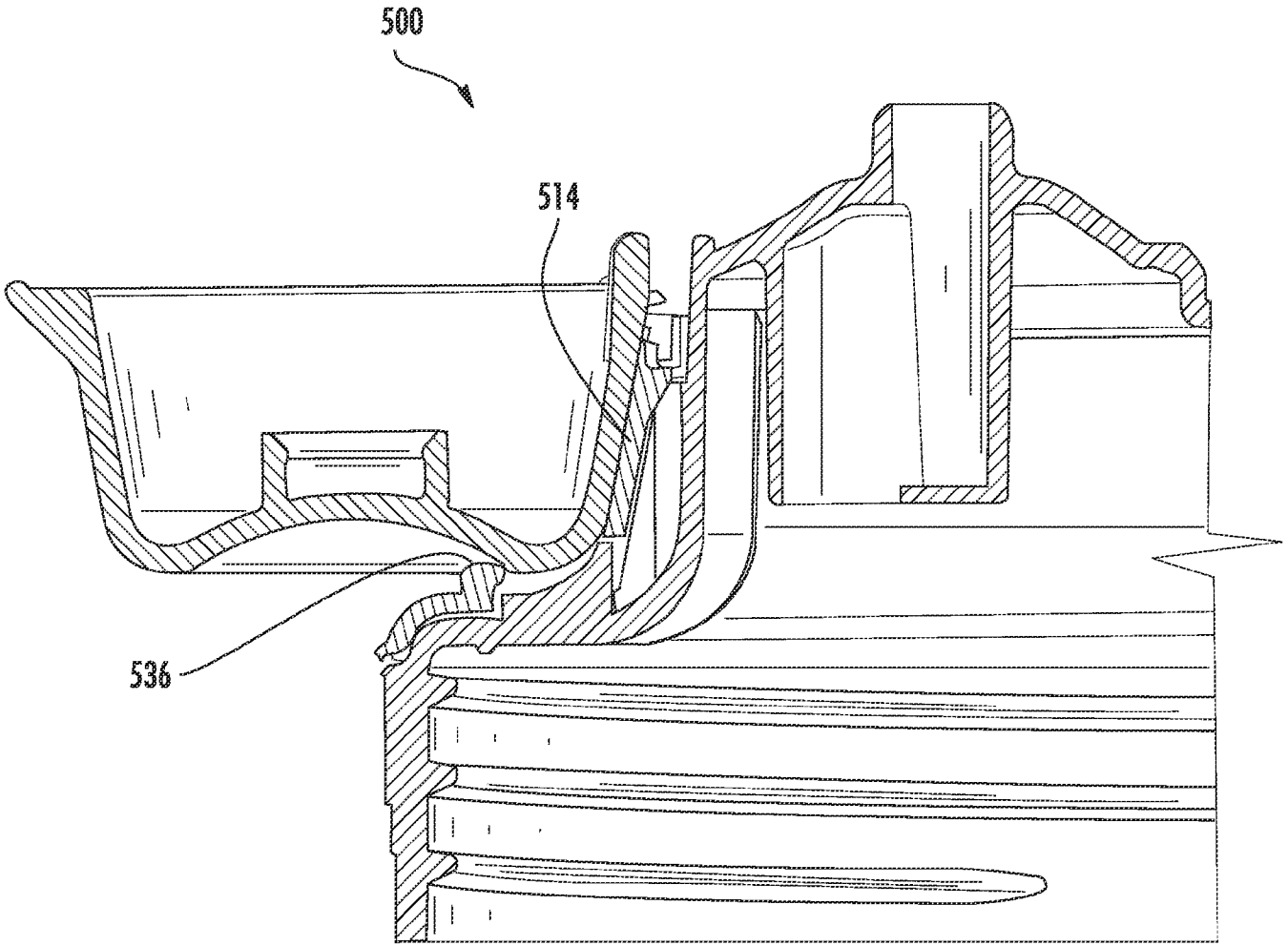
FIG. 25 is a cross-section view of a sixth embodiment of the invention illustrating a second latch back feature.
Figure 26:
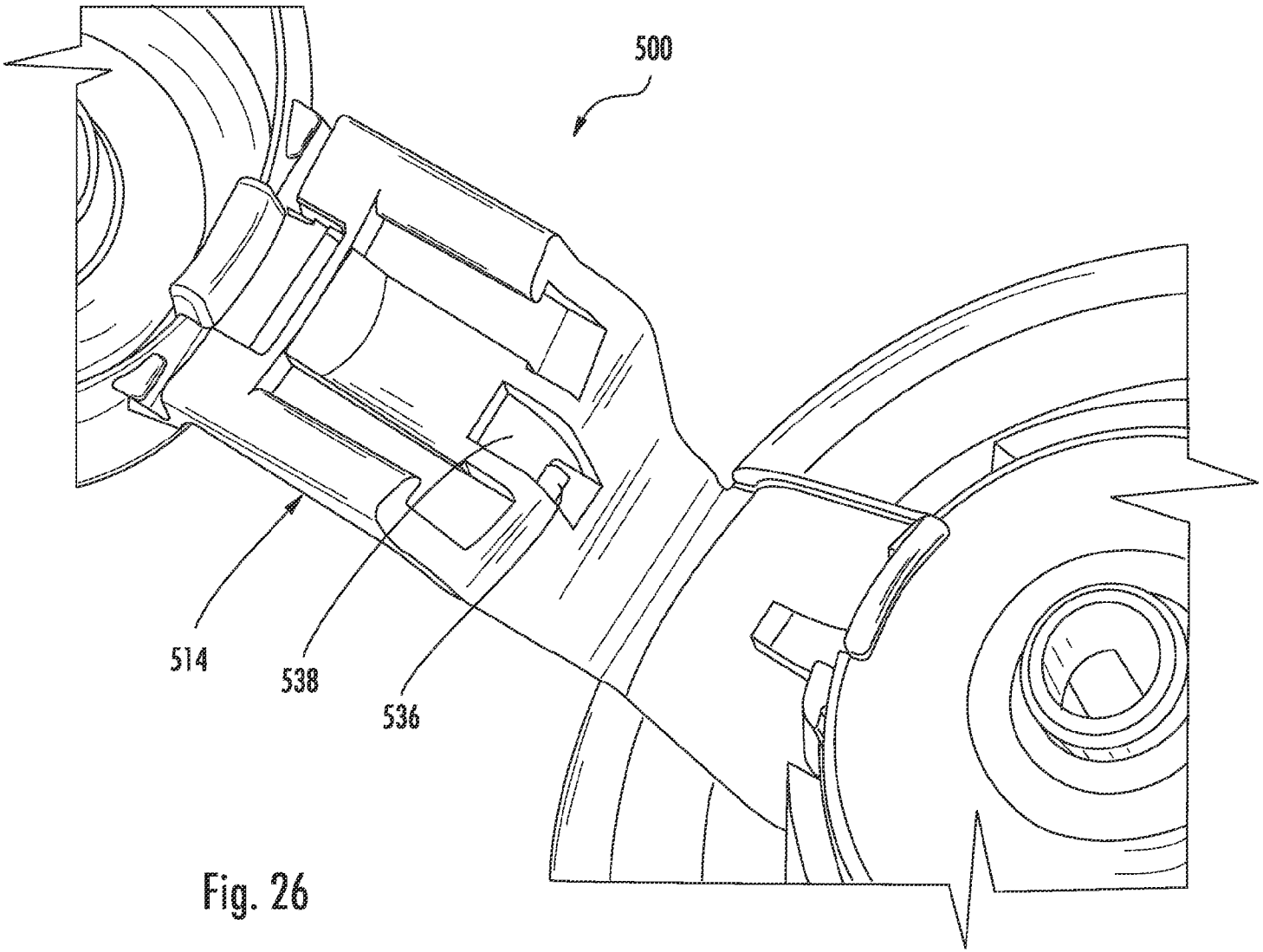
FIG. 26 is a bottom perspective view thereof showing the hinge body in an open position.
Figure 27:
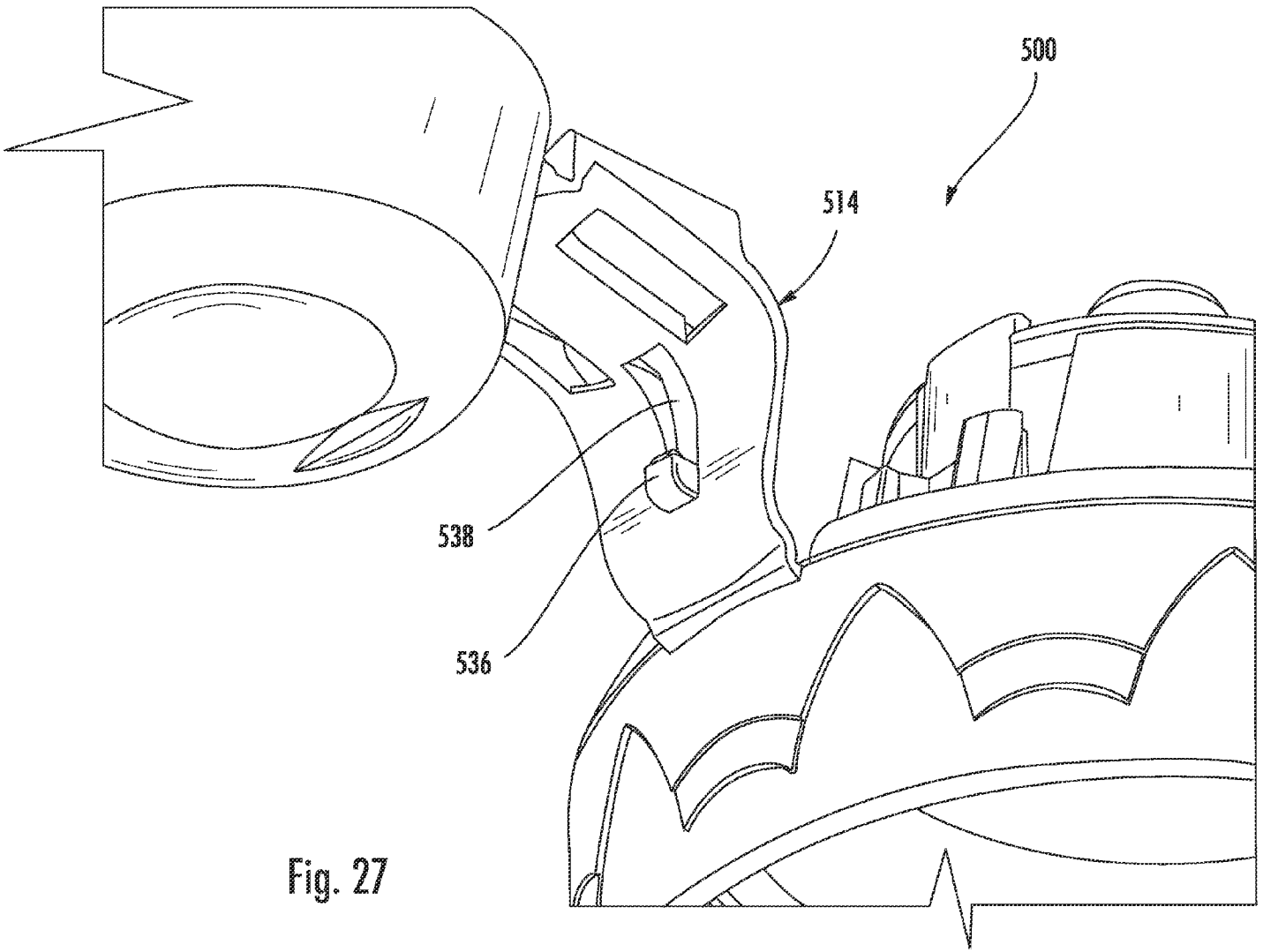
FIG. 27 is a top perspective view thereof showing the position of the latch bump and the clearance window.

Referring now to FIGS. 25-27, a sixth embodiment 500 of the dispensing closure is illustrated. This embodiment 500 is substantially similar to the fifth embodiment 400, except that the latch bump 536 is molded on the hinge body 514 rather than on the closure deck 524 (See FIGS. 25 and 27). This configuration requires a molding window 538 to be formed in the hinge body 514 in order to mold the latch bump 536 without an undercut in the mold.

Although the present invention has been described in considerable detail with reference to certain preferred embodiments thereof, other versions are possible to those with ordinary skill in the art. For example, other means could be used to attach the closure to the container other than screw threads, such as a snap-rim. Also, other arrangements of the interfitting mating formations could be used to anchor the hinge body to the upper peripheral skirt. Therefore, the scope of the appended claims should not be limited to the description of the preferred embodiments contained herein.

Figure 28:
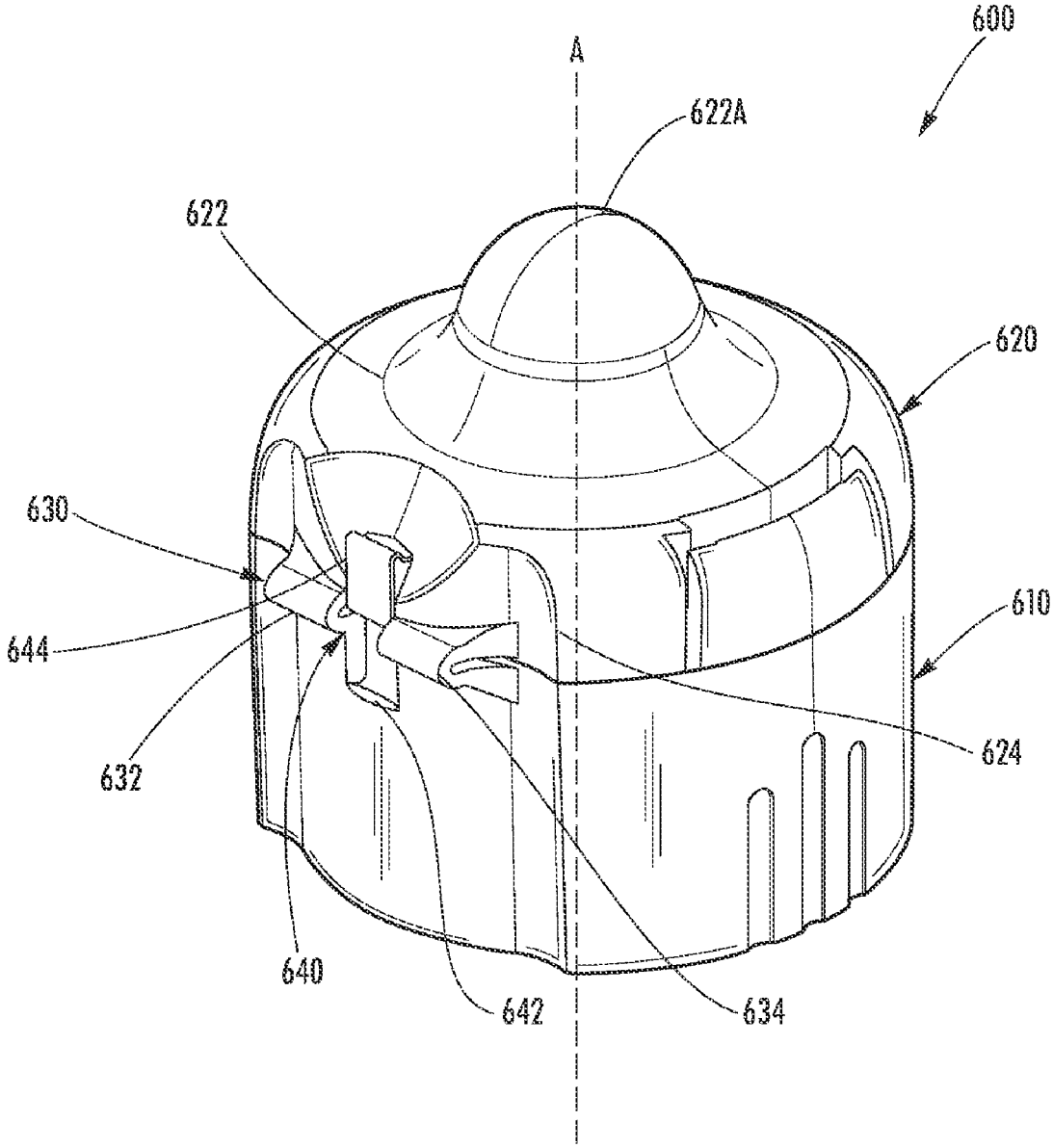
FIG. 28 is a rear perspective view of an alternative embodiment of the invention wherein the closure body and the closure cap have a latch mechanism.

Referring now to FIGS. 28-33, a seventh embodiment of the dispensing closure 600 is illustrated and includes all or many of the advantages of the previous embodiments recited above. Referring to FIG. 28, the dispensing closure 600 generally includes a closure body 610, a closure cap 620, and a hinge structure 630 for connecting the closure body 610 to the closure cap 620. The closure cap is configured to move from an open position (FIG. 29) to a closed position (FIG. 28) overlying a closure deck 670 of the closure body 610.

The seventh embodiment further includes another embodiment of the latch back mechanism 640 having a latch recess 642 defined within the closure body 610 and a latch protrusion 644 on the closure cap 620, which will allow the cap 620 to be retained in an open position during dispensing of product. See FIG. 29 for fully open, latched position.

The dispensing closure 600 may be secured to an upper end of a neck of a container (not shown). The container may assume the form of a bottle or other container made of plastic other materials, which may be tilted, and squeezed, to discharge its contents through the dispensing closure 600. FIG. 28 illustrates the dispensing closure 600 in its as-molded condition, prior to its attachment to the container (not shown).

The closure cap 620 has an upper wall 622 and a wall flange 624 which depends from the upper wall 620. The upper wall 622 may define a raised surface portion 622A designed to overlie the closure body 610 when the closure cap 620 is in a closed position. In one embodiment, the raised surface portion 622A defines an inverted U shape or contoured surface which extends along a curved surface to the wall flange 624. The hinge structure 630 joins the wall flange 624 to the closure body 610.

In one embodiment, the closure body 610 is hingedly connected to the closure cap 620. The closure cap 620 is pivoted relative to the closure body 610 using the hinge structure 630. In one embodiment, the hinge structure 630 is a double hinge including a first living hinge 632 and a second living hinge 634. The first 632 and second living hinge 634 have a surface area with an aperture defined between the first 632 and second living hinge 634 surface areas. The first 632 and second living hinges 634 having sufficient elasticity and flexibility of material to latch back the closure cap 620 and secure it to the closure body 610 using the latch back mechanism 640. The aperture providing sufficient clearance to allow the latch back mechanism 640, which shall be explained further below, to be engaged between the first 632 and second living hinge 634.

Figure 29:
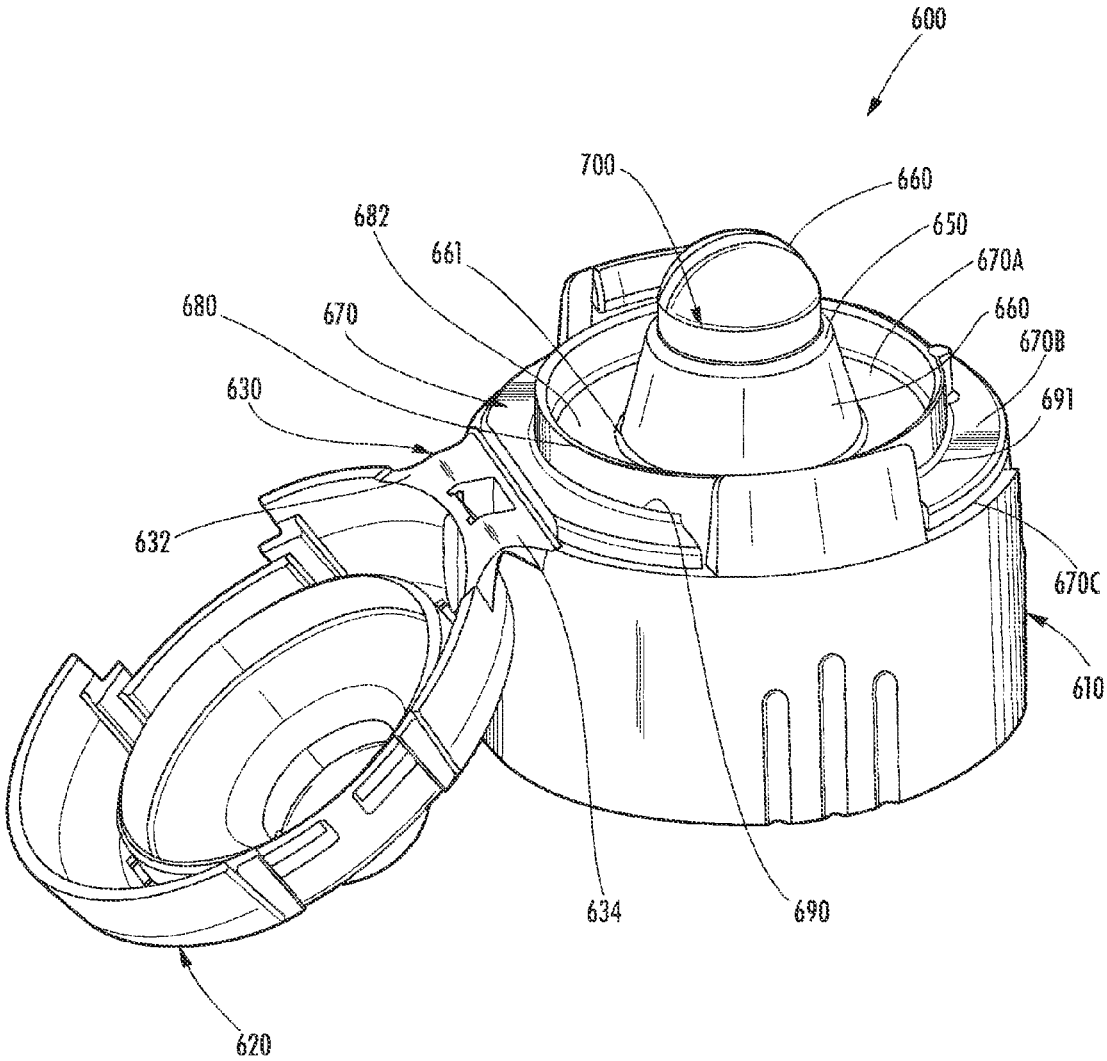
FIG. 29 is a rear perspective view of the invention of FIG. 28 wherein the closure cap is in an open position.

Referring to FIG. 29, the closure body 610 includes a first upper wall 650 depending upwardly from the closure body 610. The first upper wall 650 has a dispensing orifice 660 defined therein. The first upper wall 650 is configured for engaging an inner surface of the closure lid 620. In one embodiment, the first upper wall 650 has a surface area sufficient to engage or seat the closure lid 620 over the closure body 610.

The closure body 610 further includes a first upper peripheral skirt 660 depending from the first upper wall 650. The first upper peripheral skirt 660 defines a cylindrical shape with a gradually increasing diameter along its length. In one embodiment, the lower portion of the first upper peripheral skirt has a lower bead 661 extending along its outer periphery adjacent or near a closure deck 670.

The closure deck 670 depends from a lower portion of the first upper peripheral skirt 660 or the lower bead 661 of the first upper peripheral skirt 660. The closure deck 670 defines a generally smooth surface with a diameter similar to the diameter of the closure cap 620. The closure deck 670 is designed to engage an outer surface of the closure cap 620 when in a closed position. The closure deck 670 is positioned substantially along a horizontal axis and may have more than one tier.

A second upper wall 680 depends upwardly from the closure deck 670 and below the first upper wall 650. The second upper wall 680 extends about the periphery of the first upper wall 650 and generally has a diameter greater than the first upper wall 650. The second upper wall 680 is configured to engage an inner surface of the closure cap 620. In addition, the second upper wall 680 may define an excess product retaining area 680 between the first upper wall 650 and the second upper wall 680.

The closure body 610 further includes a second upper peripheral skirt 690 depending from the second upper wall 680. The second upper peripheral skirt 690 defines a cylindrical shape with a substantially uniform width. In one embodiment, the lower portion of the second upper peripheral skirt 690 has a lower bead 691 extending along its outer periphery adjacent to the closure deck 670.

In one embodiment, there maybe more than one closure deck 670. A first closure deck 670A may depend from the first upper peripheral skirt 660. A second closure deck 670B may depend from a second upper peripheral skirt 690. A third closure deck 670C may depend downwardly from the second closure deck 670B at a tier below the second 670B and first closure deck 670A. The third closure deck 670C is configured to seat or engage an outer periphery of the closure cap 620 when the closure cap is in a closed position. In one embodiment, the first closure deck 670A, the second closure deck 670B, and the third closure deck 670C, are integrally formed and are positioned on a substantially horizontal axis.

Figure 30:
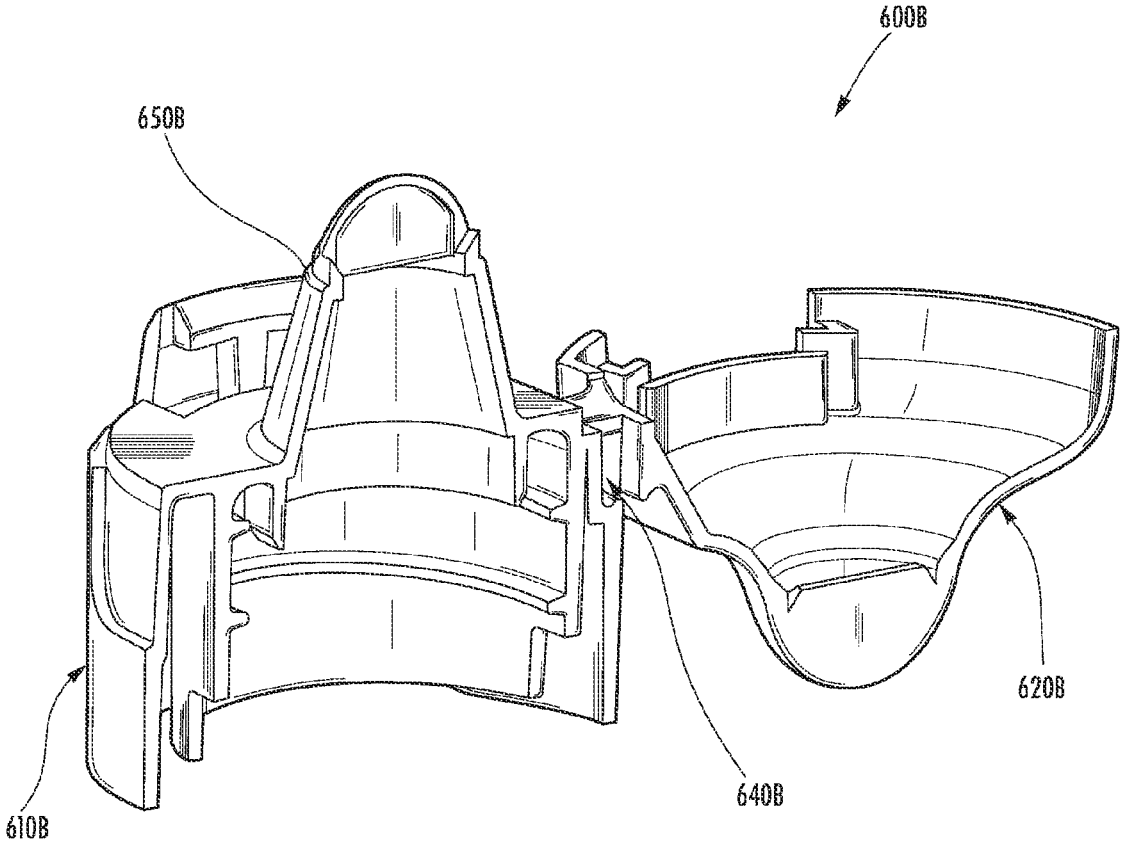
FIG. 30 is a cross-sectional view of another embodiment wherein the closure body and the closure cap have a latch mechanism.

Referring to FIG. 30, another embodiment of a dispensing closure 600B is illustrated. The dispensing closure 600B includes a latch back mechanism 640B for latching back the closure cap 620B to the closure body 610B. The dispensing closure 600B has a first upper wall 650B and a first upper peripheral skirt 660B but does not include a second upper wall 680 or a second upper peripheral skirt 690. Alternatively, the dispensing closure 650B may not have a first upper wall 650B and a first upper peripheral skirt 660B.

Figure 31:
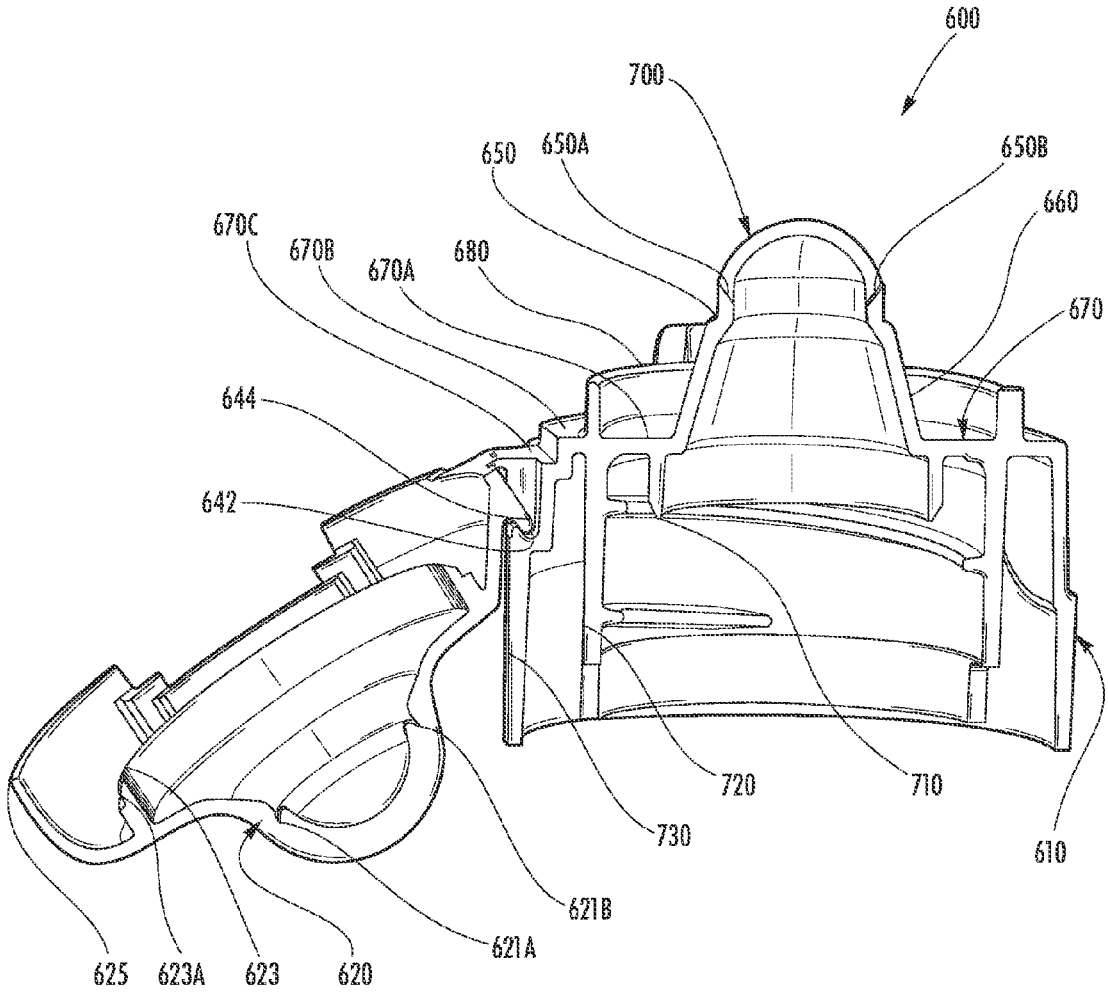
FIG. 31 is a cross-sectional view of the invention of FIG. 28 wherein the closure cap is in an open position.

Referring to FIG. 31, a flow conduit 700 may depend upwardly from the first upper wall 650 and is positioned above and below the closure deck 670. The lower portion of the flow conduit 700 includes an inner flow conduit wall 710 depending downwardly from the first closure deck 670A. A top portion or tip of the flow conduit 700 may define a raised convex or contoured surface with a rectangular dispensing orifice 660 defined therein. In one embodiment, the flow conduit 700, the first upper wall 650, and the first upper peripheral skirt 660 may be integrally formed which are positioned substantially along a vertical axis.

The closure body 610 further includes a first 730 and second lower peripheral skirt 720 depending from the closure deck 670. The first lower peripheral skirt 730 having a diameter greater than the second lower peripheral skirt 720. The first 730 and second lower peripheral skirt 720 spaced apart to provide sufficient space for a neck of a product container (not shown). In one embodiment, the first lower peripheral skirt 730 depends from the second 670B or third closure decks 670C or both. The first lower peripheral skirt 730 has a diameter larger than the first 660 and second upper peripheral skirt 690.

Also, the second lower peripheral skirt 720 may depend from the first 670A or second closure deck 670B or both. The second lower peripheral skirt 720 is also respectively positioned below the second upper wall 680 and the second upper peripheral skirt 690. An inner surface of the second lower peripheral skirt 720 is configured to mount to a container. In one embodiment, the inner surface of the second lower peripheral skirt 720 has one more threads for threadable engagement with a threaded neck of a product container. The threads on the inner surface of the second lower peripheral skirt 720 may terminate at or near the inner flow conduit wall 710. The second lower peripheral skirt 720 having a diameter approximately equal to the second upper peripheral skirt 690 and a greater diameter than the first upper peripheral skirt 660.

Referring to FIG. 31, an inner surface of the closure cap 620 is interfittingly mated or engaged with an outer surface of the closure body 610 to secure the cap 620 to the closure body 610 when the closure cap 620 is in a closed position. More specifically, the closure cap 620 defines a first engagement area which is a pair of inner recesses 621A,B defined within an inner surface of the raised surface portion 622A for receiving the first upper wall 650 of the closure body 610. The first upper wall 650 may define mating formations 650A, 650B for interfitting engagement with the pair of first inner recesses 621A,B The closure cap 620 defines a second engagement area which is an inner cap wall 623 depending from the inner surface of the closure cap 620 having an edge 623A which is interfittingly mated with the second upper wall 680 of the closure body 610. The closure cap 620 defines a third engagement area which is an outer peripheral edge 625 of the closure cap 620 which engages the third closure deck 670C of the closure body 610.

The first and second living hinges 632, 634 are positioned or pushed inwardly towards a center axis A of the closure body 610 and within an outer periphery or diameter of the closure cap 620. The first living hinge 632 connects or joins a lower portion of the wall flange 624 to a top portion of the first lower peripheral skirt 730 or closure deck 670, notably the third closure deck 670C, or both. The second living hinge 634 connects or joins a lower portion of the wall flange 624 to the top portion of the first lower peripheral skirt 730 or closure deck 670, notably the third closure deck 670C, or both.

Figure 32:
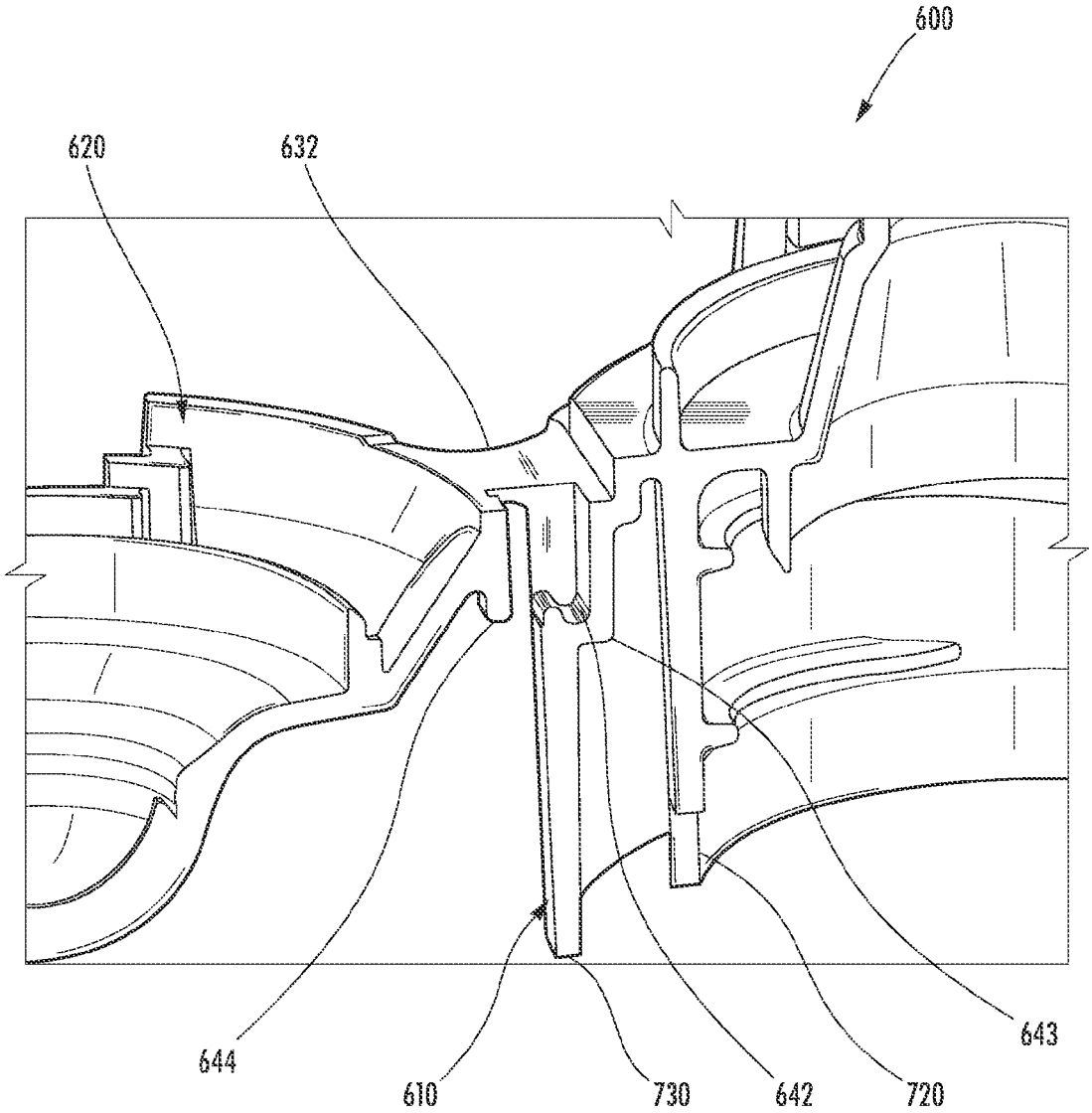
FIG. 32 is a fragmentary view of the invention of FIG. 28 wherein the closure cap is an open position.
Figure 33:
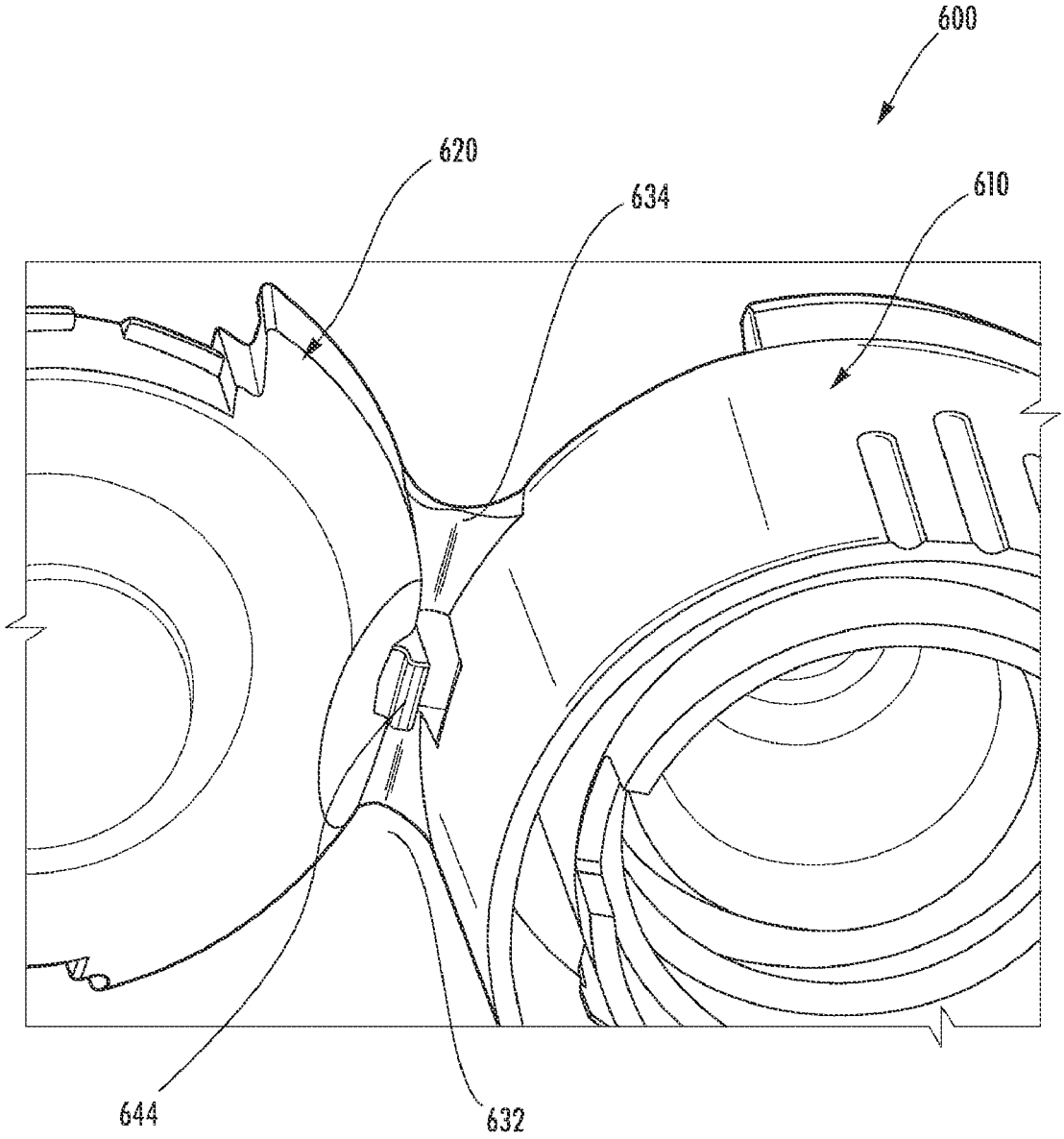
FIG. 33 is a bottom view of the invention of FIG. 28.

Referring to FIGS. 32 and 33, the closure body 610 and closure cap 620 include a latch back mechanism 640 for latching back or securing the closure cap 620 to the closure body 610 into a temporary or permanent latch back position (FIG. 31) during dispensing of product through the exit or dispensing orifice 660. The latch back mechanism 640 includes a latch recess 642 defined in the closure body 610 and a latch protrusion 644 extending from the closure cap 620.

The latch recess 642 is defined within the first lower peripheral skirt 730 of the closure body 610. In one embodiment, an outer surface of the first lower peripheral skirt 730, extending from a top portion to a bottom portion, is substantially flattened, non-curved, or recessed to reduce its diameter and allow the hinge structure 630 and the latch mechanism 640 sufficient surface area to be within the diameter of the closure cap 620 and the closure body 610. The latch recess 642 may be positioned, located, or defined between, adjacent, or near the first living hinge 632 and the second living hinge 634. In a preferred embodiment, the latch recess 642 is defined below the aperture of the first 632 and second living hinge 634 with a width equal to or less than the aperture of the first and second living hinge. Of course, it is contemplated that the latch recess 642 may be defined within the second lower peripheral skirt 720 in the absence of a first lower peripheral skirt 730.

The first lower peripheral skirt 730 defines a horizontal ledge 643 at or near a top or middle portion of the first lower peripheral skirt 730. Of course, the horizontal ledge 643 may be defined at any point along a length of the first lower peripheral skirt 730. In one embodiment, the latch recess 642 is defined within the horizontal ledge 643 of the first lower peripheral skirt 730. The latch recess 642 may define a generally, u-shaped, concave mating formation or another mating formation capable of interfittingly mating with the latch protrusion 644.

The latch protrusion 644 may be positioned or located on the wall flange 624 of the cap 620 and positioned respectively above the latch recess 642 when the closure cap 620 is in a closed position (FIG. 28). In one embodiment, the latch protrusion 644 is positioned along a vertical axis within or near the aperture defined between the first 632 and second living hinge 634. It is contemplated that the latch protrusion 644 may also be located on both the wall flange 624 and the upper wall 622 of the closure cap 620.

A portion of the closure cap 620 is recessed for attaching the latch protrusion 644 to the wall flange 624, upper wall 622, or both of the closure cap 620. In addition, an outer surface of the wall flange 624, upper wall 622 or both is substantially flattened, non-curved, or recessed to reduce its diameter and allow the hinge structure 630 and the latch mechanism 640 sufficient area to be within the diameter of the closure cap 620 and the closure body 610. The latch protrusion 644 may be integrally formed with the closure cap 620. In one embodiment, the latch protrusion 644 defines a generally inverted u-shaped, convex mating formation. Of course, the mating formation defined on the latch protrusion 644 and the latch recess 642 may have more than one shape and can be configured in many ways to facilitate an interlocking or interfitting connection. The latch protrusion 644 and the latch recess 642 define interfitting mating formations which engage to secure the cap 620 to the closure body 610 when the closure cap 620 is in an open position.

In operation, referring to FIG. 29, the closure cap 620 is pivoted, inclined, or hinged relative to the closure body 610 into an open position. The closure cap 620, when in an open position, has a latch back mechanism 640 which may facilitate the securing of the closure cap 620 to the closure body 610 during dispensing of product. In particular, referring to FIG. 31, the latch protrusion 644 of the closure cap 620 engages, seats, contacts the latch recess 642 of the closure body 610 to secure the closure cap 620 into a temporary or permanent latched position. At the appropriate angle of the closure body 610 relative to the closure cap 620, the latch protrusion 644 interfittingly engages the latch recess 642 to "latch back" the closure cap 620 to the closure body 610 during dispensing of a product from the container. In one embodiment, the latch protrusion 644 and the latch recess 642 engage when the closure cap 620 is below an approximate angle of thirty degrees. Of course, the closure cap 620 and the closure body 610 may be adjusted and configured to provide engagement of the latch recess 642 and the latch protrusion 644 at an angle above or below thirty degrees. After the product is properly dispensed, the closure cap 620 is moved from a temporary latched position (FIG. 31) to a closed position (FIG. 28) whereby the closure body engages the engagement area or areas of the closure cap 620 to prevent the flow of product out of the dispensing orifice.

In summary, the seventh embodiment of the present invention includes a dispensing closure 600 having a latch back mechanism 640. The latch back mechanism 640 having a latch recess 642 and a latch protrusion 644. When the latch protrusion 644 is engaged within the latch recess 642, the cap 620 is retained in an open position during dispensing. By latching back the cap 620 and securing it to the closure body 610, the user is able to dispense product out of the dispensing orifice 660 without worry of interference from the closure cap 620.

It would be appreciated by those skilled in the art that various changes and modifications can be made to the illustrated embodiments without departing from the spirit of the embodiments. All such modifications and changes are intended to be covered by the appended claims.

What is claimed is:

1. A dispensing closure, comprising:

a closure body;

a cap hingedly connected to said closure body;

a first living hinge joining said closure body to said cap;

a second living hinge joining said closure body to said cap;

a latch recess defined within the closure body and positioned between the first living hinge and the second living hinge; and a latch protrusion on the cap positioned respectively above said latch recess in a closed position of said closure cap, and said latch protrusion and said latch recess defining interfitting mating formations which engage to secure said cap to said closure body when the cap is in an open position.

2. The dispensing closure of claim 1, wherein said first and second living hinges are positioned inwardly towards a center axis of the closure body and within an outer periphery of said cap.

3. The dispensing closure of claim 1, wherein cap is pivoted approximately 30 degrees below said closure body to engage said latch protrusion with said latch recess.

4. The dispensing closure of claim 1, wherein a portion of the closure cap is recessed for attaching said latch protrusion.

5. The dispensing closure of claim 1, wherein an inner surface of said closure cap is interfittingly mated with an outer surface of said closure body.

6. The dispensing closure of claim 1, wherein the closure body includes a a first upper wall having a dispensing orifice, said closure body further includes an upper peripheral skirt depending from said upper wall, a closure deck depending from the upper peripheral skirt, a second upper wall depending from said closure deck.

7. The dispensing closure of claim 6, wherein the closure body includes a first and second lower peripheral skirt depending from said closure deck, said second lower peripheral skirt respectively positioned below said second upper wall and being configured to be mounted on a container, said first lower peripheral skirt having a diameter larger than said upper peripheral skirt and said second lower peripheral skirt.

8. The dispensing closure of claim 1, wherein the closure cap has an upper wall and a wall flange depending from said upper wall.

9. The dispensing closure of claim 7, further comprising:

a flow conduit depending from the upper wall of the closure body and positioned above and below the dispensing orifice, said lower portion of said flow conduit including an inner flow conduit wall depending downwardly from the closure deck.

10. The dispensing closure of claim 7, wherein said first living hinge joins said wall flange to a top portion of said first lower peripheral skirt.

11. The dispensing closure of claim 7, wherein said second living hinge joining said wall flange to the top portion of said first lower peripheral skirt, said cap being movable from an open position to a closed position overlying said closure deck of said closure body.

12. The dispensing closure of claim 7, wherein a latch recess defined within said first lower peripheral skirt positioned between said first and second living hinge.

13. The dispensing closure of claim 7, wherein a latch protrusion on the wall flange of said cap positioned respectively positioned above said latch recess defined within said first lower peripheral skirt in a closed position of said closure cap.

14. A dispensing closure, comprising:

a closure body having a closure deck with a dispensing orifice, a lower peripheral skirt depending from the closure deck, said lower peripheral skirt is configured to be mounted on a container;

a cap having an upper wall and a wall flange depending from said upper wall;

a hinge structure joining said wall flange to said lower peripheral skirt;

a latch recess defined within said lower peripheral skirt; and a latch protrusion on the wall flange of said cap positioned respectively positioned above said latch recess in a closed position of said closure cap, and said latch protrusion and said latch recess defining interfitting mating formations which engage to secure said cap to said closure body when closure cap is in an open position.

15. The dispensing closure of claim 14, wherein said hinge structure is a first and second living hinge, said first and second living hinges are positioned inwardly towards a center axis of the closure body and within an outer periphery of said cap.

16. The dispensing closure of claim 14, wherein cap is pivoted approximately 30 degrees below said closure body to engage said latch protrusion within said latch recess.

17. The dispensing closure of claim 14, wherein a portion of the closure cap is recessed for attaching said latch protrusion.

18. The dispensing closure of claim 14, wherein an inner surface of said closure cap is interfittingly mated with an outer surface of said closure body.

19. The dispensing closure of claim 14, wherein the closure body includes an upper wall having a dispensing orifice.

20. The dispensing closure of claim 19, wherein the closure body further includes an upper peripheral skirt depending from the upper wall, said closure deck depending from the upper peripheral skirt.

21. The dispensing closure of claim 19, wherein the closure body includes a first upper wall and a second upper wall, said first upper wall having a dispensing orifice, said second upper wall depending from said closure deck.

22. The dispensing closure of claim 21, wherein the closure body includes a first and second lower peripheral skirt depending from said closure deck, said second lower peripheral skirt respectively positioned below said second upper wall, said second lower peripheral skirt being configured to mount to a container, said first lower peripheral skirt having a diameter larger than said upper peripheral skirt and said second lower peripheral skirt.

23. The dispensing closure of claim 21, further comprising:

a flow conduit depending from the first upper wall of the closure body and positioned above and below the dispensing orifice, said lower portion of said flow conduit including an inner flow conduit wall depending downwardly from the closure deck.

24. The dispensing closure of claim 14, wherein the latch recess and the latch protrusion are positioned within an outer periphery of the closure cap.

25. A dispensing closure, comprising:

a closure body having a closure deck with a dispensing orifice, a lower peripheral skirt depending from the closure deck, said lower peripheral skirt having an inner surface configured to be mounted to a container, said lower peripheral skirt defining a horizontal ledge;

a cap hingedly connected to said closure body, said cap having a wall flange;

a hinge structure for connecting the closure body to the cap;

a latch recess defined within said horizontal ledge, said latch recess defining a generally u-shaped, concave formation, the latch recess positioned adjacent said double hinge; and a latch protrusion depending from the cap and positioned respectively above said latch recess when closure cap is in closed position, and said latch protrusion defining a generally inverted u-shaped convex mating formation, and said latch recess and latch protrusion defining interfitting mating formations which engage to secure said cap to said closure body when closure cap is in an open position.

* * * * *